US005198329A

United States Patent [19]

Noguchi et al.

[11] Patent Number: 5,198,329

[45] Date of Patent: Mar. 30, 1993

[54] SILVER HALIDE PHOTOGRAPHIC MATERIAL CONTAINING AN ANTIBIOTIC

[75] Inventors: Yoshihisa Noguchi; Kuniyasu Chinda; Tuyoshi Sugiyama, all of Kanagawa, Japan

[73] Assignee: Fuji Photo Film Co., Ltd., Kanagawa, Japan

[21] Appl. No.: 774,485

[22] Filed: Oct. 10, 1991

[30] Foreign Application Priority Data

Oct. 11, 1990 [JP] Japan ..... 2-272812

[51] Int. Cl.[5] ..... G03C 1/76; G03C 1/37

[52] U.S. Cl. ..... 430/523; 430/607; 430/613

[58] Field of Search ..... 430/640, 607, 613, 642, 430/523; 536/13.6, 13.9, 16.8; 252/356, 357

[56] References Cited

U.S. PATENT DOCUMENTS 3,828,021 8/1974 Beattie et al. ..... 536/13.6
3,832,286 8/1974 Weinstein et al. ..... 536/13.9
4,831,123 5/1989 Tann et al. ..... 536/13.9
4,923,790 5/1990 Kato et al. ..... 430/640

FOREIGN PATENT DOCUMENTS 1384645 11/1964 France .

OTHER PUBLICATIONS

"Franck'Sche Verlagsbuchhandlung", O. A. Neumuller (Ed.), Römpps Chemie-Lexikon, Ed. 8, vol. 1:A-CI (1979).

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halide photographic material contains at least one aminoglycoside selected from the compound group consisting of gentamicin, amikacin, tobramycin, dibekacin, arbekacin, micronomicin, isepamicin, sisomicin, netilmicin, and astromicin, in a hydrophilic colloidal layer on a support.

5 Claims, No Drawings

SILVER HALIDE PHOTOGRAPHIC MATERIAL CONTAINING AN ANTIBIOTIC

FIELD OF THE INVENTION

The present invention relates to a silver halide photographic material.

BACKGROUND OF THE INVENTION

A silver halide photographic material comprises silver halide emulsion layers and various auxiliary layers (e.g., subbing layer, interlayer, ultraviolet absorbent-containing layer, filter layer, antihalation layer, protective layer and backing layer) coated on a support. The coated layers comprise a hydrophilic colloid typified by gelatin.

However, it has been known that such a hydrophilic colloid rots or decomposes under the action of bacteria or fungi. In particular, when a hydrophilic colloid rots or decomposes in the preparation of a photographic material, the viscosity of the coating solution and the physical properties of the coated film deteriorates. Another problem is a coating failure which is believed to result from decomposition products of the hydrophilic colloid.

Furthermore, in the case of color light-sensitive materials, color photographs obtained by color development thereof are subject to discoloration by the action of bacteria or fungi.

To inhibit putrefaction or decomposition by the action of bacteria or fungi, preservatives or fungicides have heretofore been added to the system at any of the steps in the process for the preparation of photographic light-sensitive materials. As such preservatives or fungicides there have been known various compounds as described in JP-A-54-27424 (GB 2002530A) and JP-A-63-271247 (the term "JP-A" as used herein means an "unexamined published Japanese patent application"). However, the compounds are disadvantageous in that they must be used in a large amount to attain sufficient effects and when used in a large amount are subject to precipitation. Another problem is that the compounds are harmful to humans.

It has been known to use antibiotics such as neomycin, kanamycin, streptomycin, polymycin and furamycin. However, the antibiotics are disadvantageous in that they have a low sterilizing effect and must be used in a large amount, they are effective only for specific bacteria or they are photographically harmful.

SUMMARY OF THE INVENTION

It is therefore an object of the present invention to provide a photographic preservative (or fungicide) which works effectively in small amounts.

It is another object of the present invention to provide a silver halide photographic material comprising such a preservative which exhibits a constant quality.

These and other objects of the present invention will become more apparent from the following detailed description and examples.

As a result of extensive study, aminoglycoside antibiotics, such as gentamicin, were found to render bacteria or fungi innocuous and improve storage stability of a photographic film. The aminoglycoside antibiotics, which are inexpensive and harmless to humans, do not accelerate fading of a colored image and are not detrimental to coat surface conditions of a film.

The above mentioned objects of the present invention are accomplished with a silver halide photographic material, which comprises at least one aminoglycoside selected from gentamicins, amikacin, tobramycin, dibekacin, arbekacin, micronomicin, isepamicin, sisomicin, netilmicin, and astromicin, in a hydrophilic colloidal layer on a support.

DETAILED DESCRIPTION OF THE INVENTION

The present invention will be described further hereinbelow.

Of the aminoglycosides which can be used in the present invention, gentamicins are preferably used.

Specific examples of typical gentamicins are set forth below.

| Compound No. | Gentamicins |
|---|---|
| 1 | Gentamicin $A_2$ |
| 2 | Gentamicin A |
| 3 | Gentamicin $A_1$ |
| 4 | Gentamicin B |
| 5 | Gentamicin $X_2$ |
| 6 | Antibiotic JI-20A |
| 7 | Gentamicin $B_1$ |
| 8 | Antibiotic $G_{418}$ |
| 9 | Antibiotic JI-20B |
| 10 | Gentamicin $C_1$ |
| 11 | Gentamicin $C_{1a}$ |
| 12 | Gentamicin $C_2$ |
| 13 | Gentamicin $C_{2a}$ |
| 14 | Gentamicin $C_{2b}$ |

As aminoglycosides there can be used those that are available commercially.

The characteristics, and etc., of the aminoglycosides are discussed in the "Merck Index, an Encyclopedia of Chemicals, Drugs and Biologicals", 11, ed. (1989), Merk & Co., Inc.

Of these methods for preparing the aminoglycosides, for example, the progress for preparation of the specific compounds may be mentioned as follows.

| | |
|---|---|
| Gentamicin | U.S. Pat. Nos. 3,091,572, 3,136,704 |
| Amikacin | U.S. Pat. No. 3,781,268 |
| Albekacin | U.S. Pat. No. 4,107,424 and DT 2,350,169 |
| Dibekasin | DT 2,135,191 |
| Isepamicin | U.S. Pat. No. 4,002,742 |
| Micronomicin | U.S. Pat. No. 4,045,298, and DT 2,326,781 |
| Netilmicin | U.S. Pat. Nos. 4,002,742 and 4,029,882 and DT 2,437,160 and |
| Sisomicin | U.S. Pat. No. 3,832,286 |

Aminoglycosides to be used in the present invention can be incorporated in a silver halide emulsion layer coated on a support and at least one of the above exemplified auxiliary layers, preferably all the layers.

Aminoglycosides are incorporated preferably in a coating solution containing a hydrophilic colloid in the form of an aqueous solution.

The amount of aminoglycosides may be used preferably is in the range of about 0.01 to 20 mg/m$^2$, more preferably 0.1 to 5 mg/m$^2$, in total.

The photographic material of the present invention can comprise at least each one of blue-sensitive silver halide emulsion layer, green-sensitive silver halide emulsion layer and red-sensitive silver halide emulsion layer coated on a support. In an ordinary color photographic paper, the silver halide emulsion layers normally are arranged on the support in the order described above. However, the order of arrangement of the layers may differ from that described above. An infrared-sensitive silver halide emulsion layer may be provided in place of at least one of the emulsion layers. The light-sensitive emulsion layers may contain silver halide emulsions sensitive to the respective wavelength ranges and dyes complementary to the color of light to which they are sensitive, i.e., so-called color couplers for forming yellow for blue, magenta for green and cyan for red, to provide for subtractive color reproduction. However, the correspondence of light-sensitive layer to color hue of coupler may differ from that described above.

The silver halide emulsion to be used in the present invention may comprise silver chloride, silver bromide, silver bromochloride, silver bromoiodide or the like, preferably silver bromochloride or silver chloride substantially free of silver iodide. The term "substantially free of silver iodide" as used herein means a silver iodide content of 1 mol % or less, preferably 0.2 mol % or less. The halogen composition of the emulsion may differ from grain to grain. If an emulsion having the same halogen composition from grain to grain is used, the properties of grains can be uniformed easily. The halogen composition in the silver halide emulsion grain can be selected properly from so-called uniform type grain wherein the composition is uniform in any portion, so-called lamination type grain wherein the halogen composition differs from core to shell (single layer or plural layers) and grain having a non-layered internal or surface portion differing from the other portion in halogen composition (if the portion lies on the surface of the grain, a portion with a different halogen composition may be fused to the edges, corners or faces of the grain). To obtain a high sensitivity, the latter two types of grains may be used advantageously rather than the uniform type of grain. The two types of grains preferably may be used also in view of pressure resistance. If the silver halide grain has the above-mentioned structure, the interface of the different halogen compositions may be a definite interface, an indefinite interface containing a mixed crystal formed by composition difference or a portion having a positively continuous structure change.

The silver bromochloride emulsions may have a halogen composition having any silver bromide/silver chloride ratio. The ratio can be selected widely depending on the purpose. The ratio of silver chloride is preferably 2% or more.

As a light-sensitive material suitable for rapid processing there preferably may be used a so-called high silver chloride emulsion having a high silver chloride content. The silver chloride content of such a high silver chloride emulsion is preferably 90 mol %, more preferably 95 mol % or more.

In such a high silver chloride emulsion, a silver bromide localized phase lies preferably in layers or other structures in and/or on silver halide grains. In the halogen composition of the above-mentioned localized phase, the silver bromide content is preferably at least 10 mol %, more preferably more than 20 mol %. The localized phase may lie inside the grain or on the edges, corners or faces of the grain. In a preferred example, such a localized phase is formed on the corners of the grain by epitaxial growth.

On the other hand, for the purpose of minimizing a drop in sensitivity of a light-sensitive material under pressure, a high silver chloride emulsion having a silver chloride content of 90 mol % or more preferably may comprise uniform grains having a small halogen composition distribution therein.

Furthermore, for the purpose of reducing the replenishment rate of developer, it is effective to increase further the silver chloride content of the silver halide emulsion. In that case, a substantially pure silver chloride emulsion having a silver chloride content of 98 to 100 mol % preferably may be used.

The average grain size (number average diameter of circles equivalent to the projected area of grains) of silver halide grains contained in the silver halide emulsion to be used in the present invention is preferably in the range of 0.1 to 2 μm.

The grain size distribution is preferably monodisperse such that the fluctuation coefficient thereof (obtained by dividing the standard deviation of the grain size distribution by the average grain size) is 20% or less, preferably 15% or less. For the purpose of obtaining a wide latitude, a blend of such monodisperse emulsions preferably may be incorporated in the same layer or such monodisperse emulsions preferably may be coated separately in layers.

The silver halide grains to be incorporated in the photographic emulsion may have a regular crystal form such as cube, tetradecahedron and octahedron, irregular crystal form such as sphere and tabular, or composite thereof. Alternatively, the present silver halide grains may comprise a mixture of grains having various crystal forms. In the present invention, the silver halide grains preferably comprise grains having the above-mentioned regular crystal form in a proportion of 50% or more, preferably 70% or more, more preferably 90% or more.

Moreover, an emulsion wherein tabular grains having an aspect ratio (diameter as calculated in terms of circle/thickness) of 5 or more, preferably 8 or more, account for more than 50% of all grains as calculated in terms of projected area preferably may be used.

During the formation or the physical ripening of the silver halide emulsion grains, various multivalent metal ion impurities can be incorporated in the system. Examples of such compounds include salts of cadmium, zinc, lead, copper and thallium, and salts or complex salts of the group VIII elements in the Periodic Table, e.g., iron, ruthenium, rhodium, palladium, osmium, iridium and platinum. In particular, the above-mentioned group VIII elements preferably may be used. The amount of the compounds to be incorporated can be selected widely depending on the purpose of application and is preferably in the range of $10^{-9}$ to $10^{-2}$ mol per mol of silver halide.

The silver halide emulsion to be used in the present invention normally is subjected to chemical or spectral sensitization.

The chemical sensitization can be accomplished by sulfur sensitization with, e.g., an instable sulfur compound, noble metal sensitization such as gold sensitization, and reduction sensitization, singly or in combination. As compounds to be used in the chemical sensitization there may be used preferably those described in JP-A-62-215272, lower right column on page 18 to upper right column on page 22.

The preparation of the silver bromide emulsion which can be used in the present invention can be accomplished by any suitable method as described in P. Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion", Focal Press, 1964. In some detail, the emulsion can be prepared by any of the acid process, the neutral process, the ammonia process etc. The reaction between a soluble silver salt and a soluble halogen salt can be carried out by any of one side mixing process, both side mixing process, a combination thereof and the like. A method in which grains are formed in the presence of excess silver ions (so-called reverse mixing method) may be used. Further, a so-called controlled double jet process, in which a pAg value of a liquid phase in which silver halide grains are formed is maintained at a constant level, may also be used. According to the controlled double jet process, a silver halide emulsion having a regular crystal form and an almost uniform grain size can be obtained.

The spectral sensitization is effected for the purpose of providing the emulsion in each layer in the present light-sensitive material with a spectral sensitivity in a desired light wavelength range. In the present invention, the spectral sensitization preferably is carried out by incorporating in the system a dye which absorbs light having a wavelength range corresponding to the desired spectral sensitivity, i.e., spectral sensitizing dye. Examples of such a spectral sensitizing dye include those described in F. M. Harmer, "Heterocyclic Compounds—Cyanine Dyes and Related Compounds", John Wiley & Sons (New York, London), 1964. Specific examples of such compounds and spectral sensitizing processes which preferably can be used in the present invention are described in the above cited JP-A-62-215272, upper right column on page 22 to page 38.

For the purpose of inhibiting fogging during the preparation, storage or photographic processing of the light-sensitive material or stabilizing the photographic compounds or precursors thereof can be incorporated in the silver halide emulsion. Specific examples of such compounds which preferably can be used in the present invention are described in the above cited JP-A-62-215272, pp. 39 to 72.

The emulsion to be used in the present invention may be either of the so-called surface latent image type in which latent images are formed mainly on the surface of grains or of the so-called inner latent image type in which latent images are formed mainly inside grains.

If the present invention is applied to a color light-sensitive material, the color light-sensitive material normally comprises yellow, magenta and cyan couplers which undergo a coupling reaction with an oxidation product of an aromatic amine developing agent to color yellow, magenta and cyan, respectively.

The cyan couplers which can be preferably used in the present invention are represented by the general formulae (C-I), (C-II), (M-I), (M-II) and (YY):

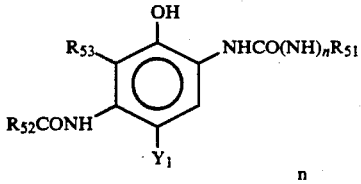

(C-I)

-continued

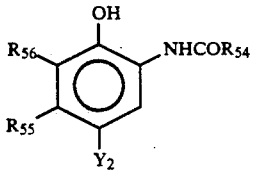

(C-II)

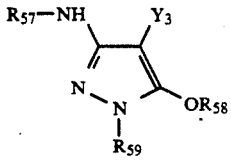

(M-I)

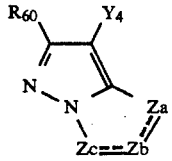

(M-II)

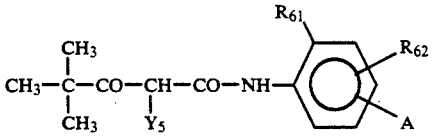

(YY)

In the general formulae (C-I) and (C-II), $R_{51}$, $R_{52}$ and $R_{54}$ each represents a substituted or unsubstituted aliphatic, aromatic or heterocyclic group. $R_{53}$, $R_{55}$ and $R_{56}$ each represents a hydrogen atom, halogen atom, aliphatic group, aromatic group or acylamino group. $R_{53}$ may represent an atomic group which forms a 5- or 6-membered nitrogen-containing ring with $R_{52}$. $Y_1$ and $Y_2$ each represents a hydrogen atom or a group releasable upon coupling reaction with an oxidation product of a developing agent. The suffix n represents an integer 0 or 1.

In the general formula (C-II), R55 is preferably an aliphatic group. Examples of such an aliphatic group include methyl, ethyl, propyl, butyl, pentadecyl, tert-butyl, cyclohexyl, cyclohexylmethyl, phenylthiomethyl, dodecyloxyphenylthiomethyl, butanamidomethyl and methylmethyl.

Preferred examples of the cyan coupler represented by the general formula (C-I) or (C-II) will be set forth below.

In the general formula (C-I), $R_{51}$ is preferably an aryl group or heterocyclic group, more preferably an aryl group substituted by a haralogen atom, alkyl group, alkoxy group, aryloxy group, acylamino group, acyl group, carbamoyl group, sulfonamide group, sulfamoyl group, sulfonyl group, sulfamide group, oxycarbonyl group or cyano group.

In the general formula (C-I), if $R_{53}$ and $R_{52}$ do not form a ring, $R_{52}$ is preferably a substituted or unsubstituted alkyl or aryl group, particularly a substituted aryloxy-substituted alkyl group, and $R_{53}$ is preferably a hydrogen atom.

In the general formula (C-II), $R_{54}$ is preferably a substituted or unsubstituted alkyl or aryl group, particularly a substituted aryloxy-substituted alkyl group.

In the general formula (C-II), $R_{55}$ is preferably a $C_{2-15}$ alkyl group or methyl group containing a substituent having one or more carbon atoms. Preferred examples of such substituents include an arylthio group, alkylthio group, acylamino group, aryloxy group and alkyloxy group.

In the general formula (C-II), $R_{55}$ is more preferably a $C_{2-15}$ alkyl group, particularly a $C_{2-4}$ alkyl group.

In the general formula (C-II), $R_{56}$ is preferably a hydrogen atom or halogen atom, particularly chlorine atom or fluorine atom. In the general formulae (C-I) and (C-II), $Y_1$ and $Y_2$ are each preferably a hydrogen atom, halogen atom, alkoxy group, aryloxy group, acyloxy group or sulfonamide group.

In the general formula (M-I), $R_{57}$ and $R_{59}$ each represents an aryl group. $R_{58}$ represents a hydrogen atom, aliphatic or aromatic acyl group or aliphatic or aromatic sulfonyl group. $Y_3$ represents a hydrogen atom or releasable group. The substituent which can be contained in the aryl group (preferably a phenyl group) represented by $R_{57}$ or $R_{59}$ is the same as the substituent which can be contained in the substituent $R_{51}$ If there are two or more substituents, they may be the same or different. $R_{58}$ is preferably a hydrogen atom or an aliphatic acyl or sulfonyl group, particularly a hydrogen atom. The releasable group represented by $Y_3$ is preferably of the type which can be released at sulfur, oxygen or nitrogen atom. For example, sulfur atom-releasable type as described in U.S. Pat. No. 4,351,897 and International Patent Disclosure W088/04795 is preferred particularly.

In the general formula (M-II), $R_{60}$ represents a hydrogen atom or substituent. $Y_4$ represents a hydrogen atom or releasable group, particularly preferably a halogen atom or arylthio group. Za, Zb and Zc each represents a methine, substituted methine, =N— or —NH—. One of the Za-Zb bond and Zb-Zc bond is a double bond and the other is a single bond. If the Zb-Zc bond is a carbon-carbon double bond, it may be part of an aromatic ring. If $R_{60}$ or $Y_4$ forms a dimer or higher polymer, or if Za, Zb or Zc is a substituted methine group, the substituted methine group may form a dimer or higher polymer.

Preferred among pyrazoloazole couplers represented by the general formula (M-II) are imidazo[1,2-b]pyrazoles as described in U.S. Pat. No. 4,500,630 because dyes developed therefrom exhibit little subsidiary absorption of yellow and excellent fastness to light. Pyrazolo[1,5-b][1,2,4]triazoles as described in U.S. Pat. No. 4,540,654 particularly are preferred.

Other preferred examples of pyrazoloazole couplers include pyrazolotriazole couplers comprising a branched alkyl group directly connected to the 2-, 3- or 6-position of the pyrazolotriazole ring as described in JP-A-61-65245, pyrazoloazole couplers containing sulfonamide groups in a molecule as described in JP-A-61-65246, pyrazoloazole couplers containing alkoxyphenylsulfonamide ballast groups as described in JP-A-61-147254 and pyrazolotriazole couplers containing an alkoxy group or aryloxy group in the 6-position as described in European Patents 226,849A and 294,785A.

In the general formula (YY), $R_{61}$ represents a halogen atom, alkoxy group, trifluoromethyl group or aryl group. $R_{62}$ represents a hydrogen atom, halogen atom or alkoxy group. A represents —$NHCOR_{63}$, —$NHSO_2$—$R_{63}$, —$SO_2NHR_{63}$, —$COOR_{63}$ or $$-SO_2\underset{\underset{R_{64}}{|}}{N}-R_{63}$$

in which $R_{63}$ and $R_{64}$ each represents an alkyl group, aryl group or acyl group. $Y_5$ represents a releasable group. The substituents to be contained in $R_{62}$, $R_{63}$ and $R_{64}$ are the same as those to be contained in $R_{51}$. The releasable group $Y_5$ is preferably of the type which can be released at oxygen atom or nitrogen atom, particularly of the nitrogenaton-releasable type.

Specific examples of couplers represented by the general formulae (C-I), (C-II), (M-I), (M-II) and (YY) are set forth below:

(C-1)

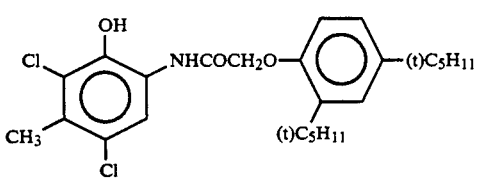

(C-2)

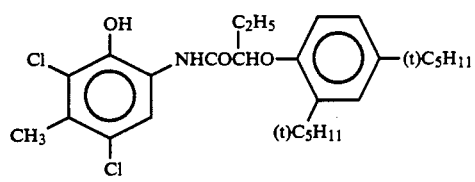

(C-3)

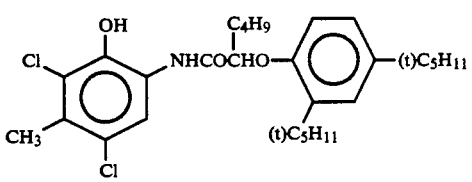

(C-4)

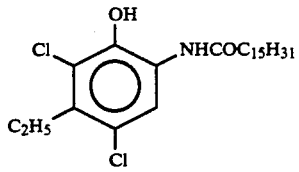

(C-5)

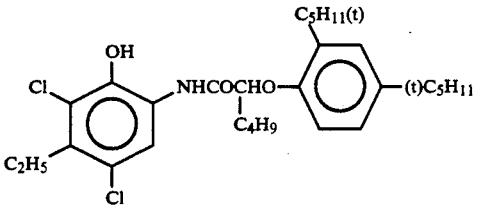

(C-6)

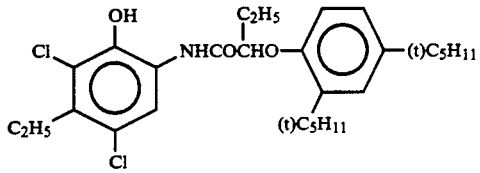

-continued
(C-7)
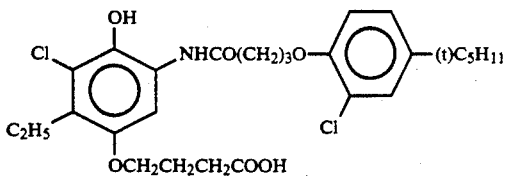
(C-8)
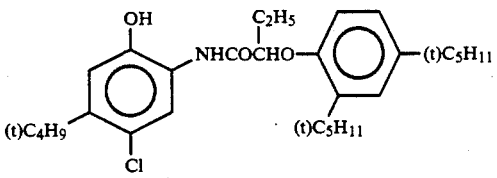
(C-9)
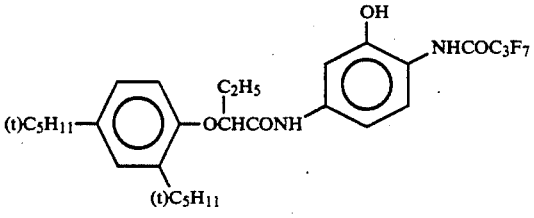
(C-10)
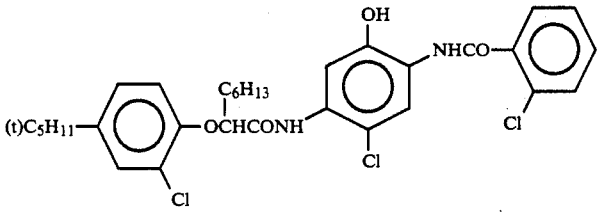
(C-11)
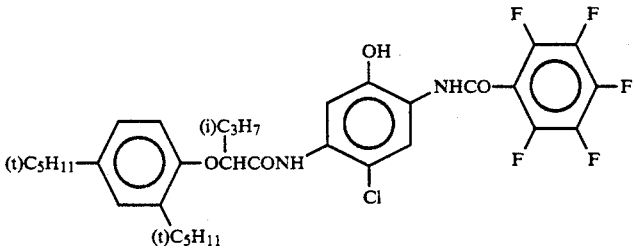
(C-12)
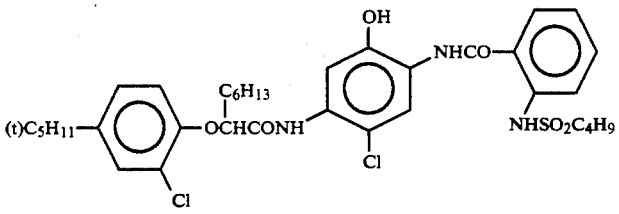
(C-13)
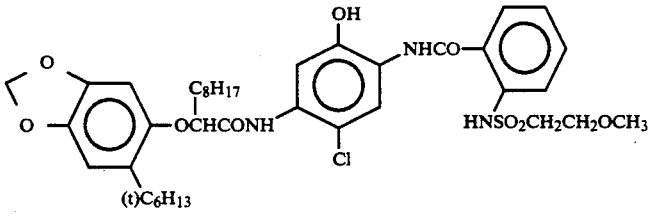
(C-14)
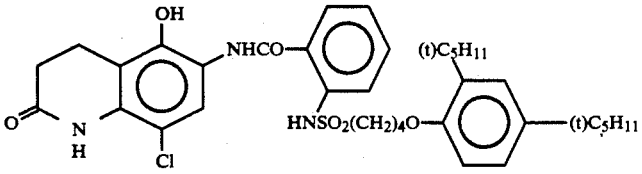

-continued
(C-15)
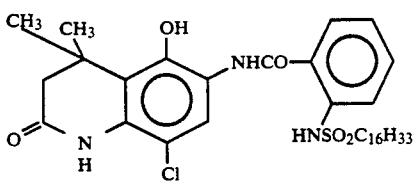
(C-16)
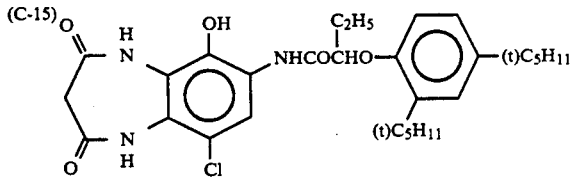
(C-17)
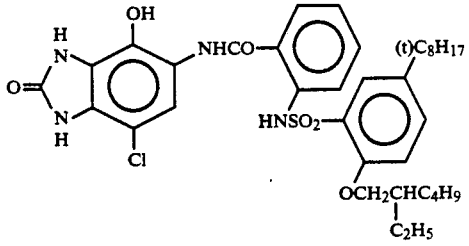
(C-18)
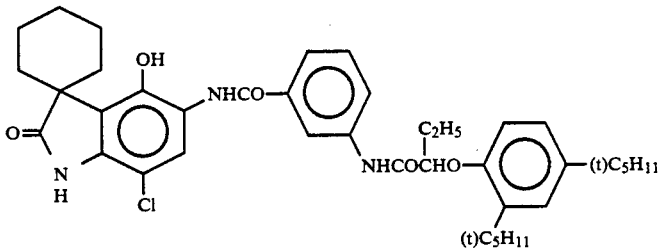
(C-19)
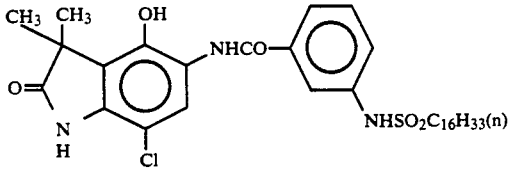
(C-20)
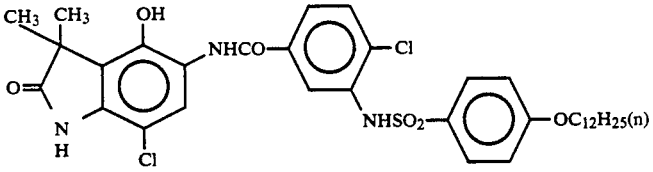
(C-21)
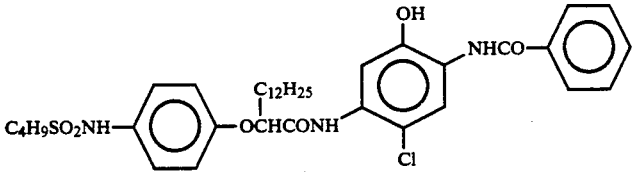
(C-22)
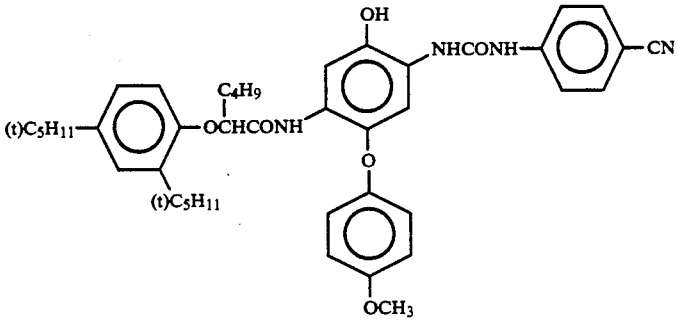

-continued
(M-1)
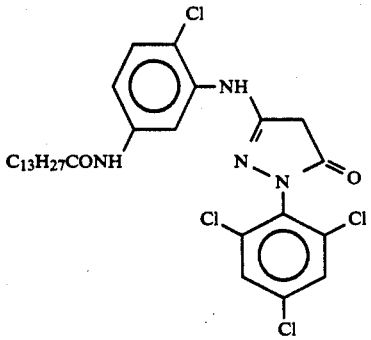
(M-2)
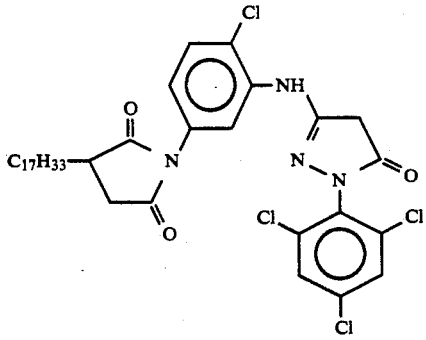
(M-3)
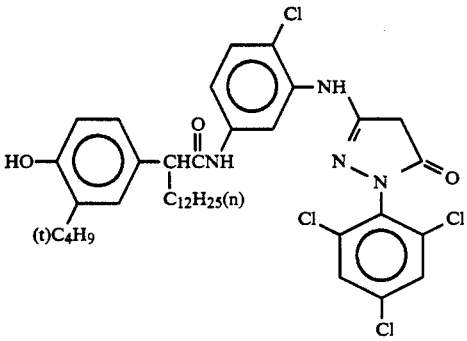
(M-4)
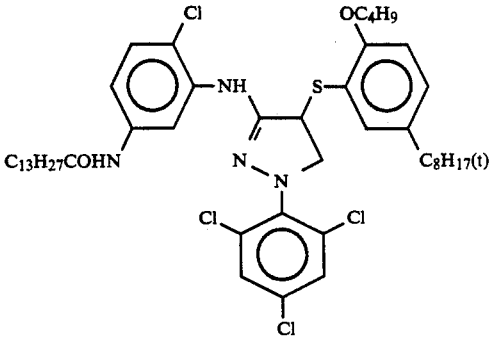
(M-5)
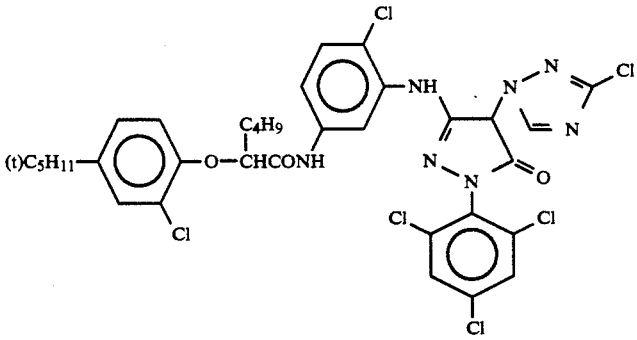
(M-6)
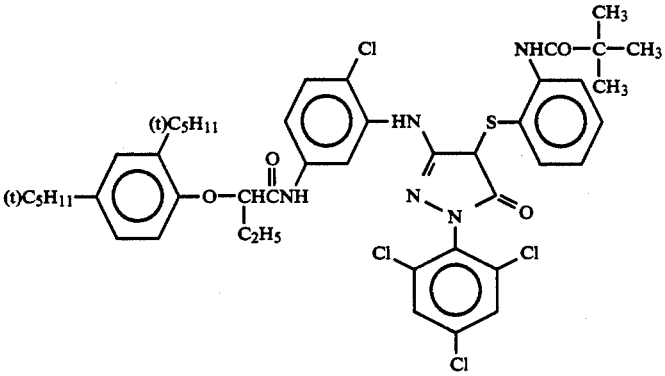

-continued
(M-7)
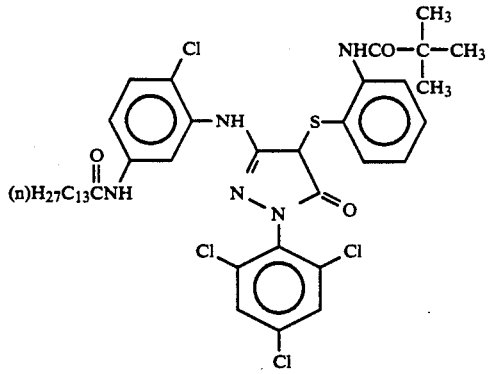
(M-8)
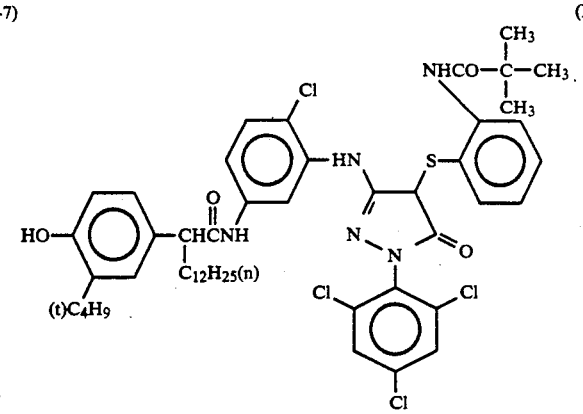

| Compound | $R_{60}$ | $R_{65}$ | $Y_4$ |
|---|---|---|---|
| | | 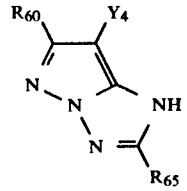 | |
| M-9 | $CH_3$— | 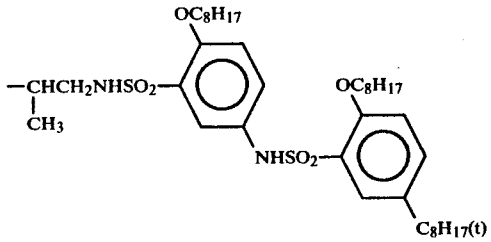 | Cl |
| M-10 | " | 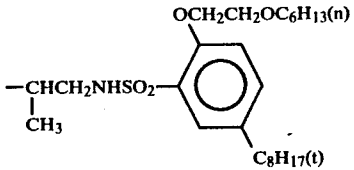 | " |
| M-11 | $(CH_3)_3C$— | 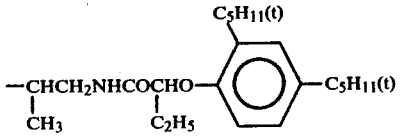 | 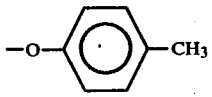 |
| M-12 | 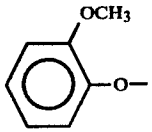 | 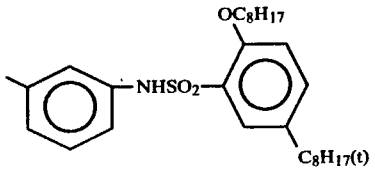 | 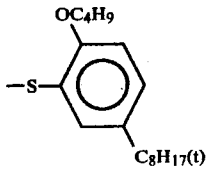 |

-continued
| Compound | $R_{60}$ | $R_{65}$ | $Y_4$ |
|---|---|---|---|
| M-13 | $CH_3$— | 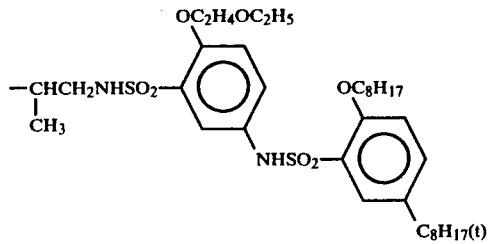 | Cl |
| M-14 | " | 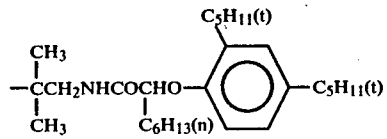 | " |
| M-15 | $CH_3$— | 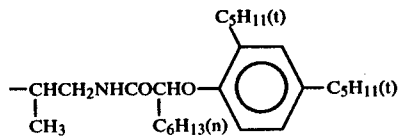 | Cl |
| M-16 | " | 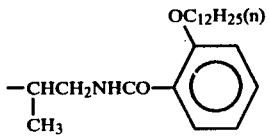 | " |
| M-17 | " | 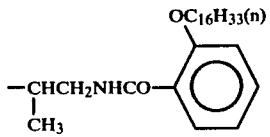 | " |

-continued
| Compound | $R_{60}$ | $R_{65}$ | $Y_4$ |
|---|---|---|---|
| M-18 | 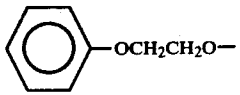 | 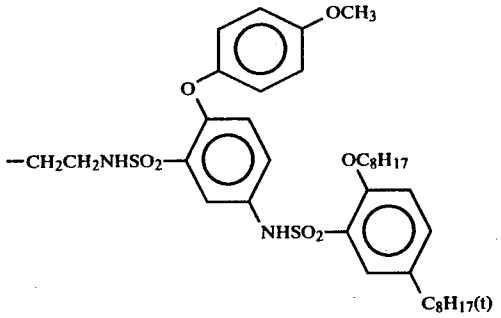 | 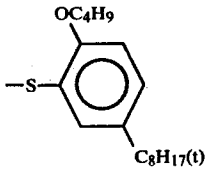 |
| M-19 | $CH_3CH_2O-$ | " | " |
| M-20 | 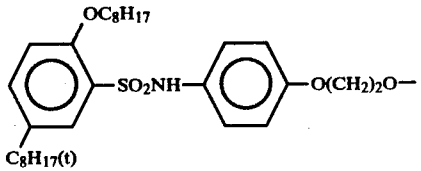 | 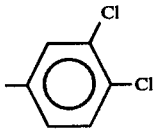 | 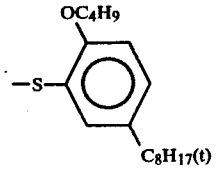 |
| M-21 | 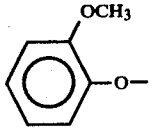 | 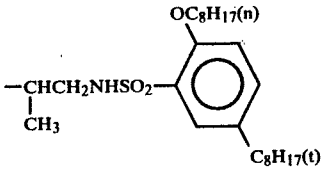 | Cl |
| M-22 | $CH_3-$ | 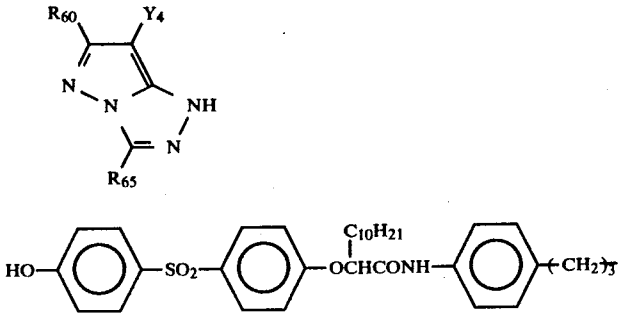 | Cl |

-continued

| Compound | $R_{60}$ | $R_{65}$ | $Y_4$ |
|---|---|---|---|
| M-23 | " | $(n)C_6H_{13}$ \ $CHCH_2SO_2(CH_2)_2$ / $(n)C_8H_{17}$ | " |
| M-24 | $CH_3$ \ $CH-$ / $CH_3$ | $OC_4H_9$; $SO_2(CH_2)_3$; $C_8H_{17}(t)$ | " |
| M-25 | $(CH-CH_2)_{50}(CH_2-C)_{50}$; $COOCH_2CH_2OCH_3$; $CH_3$; $CONH-$ | $CH_3-CH-$; $CH_2NHSO_2CH_3$ | " |
| M-26 | $-O-$ | $OC_8H_{17}$; $(CH_2)_2NHSO_2$; $C_8H_{17}(t)$ | Cl |
| M-27 | $CH_3-$ | $CH_3$; $CH_3$; $CH_3$; $NHCOCHO$; $(n)C_{10}H_{21}$; $SO_2$; $OCH_2$ | " |
| M-28 | $(CH_3)_3C-$ | $CH_3$; $CH_3$; $CH_3$; $C_5H_{11}(t)$; $NHCOCHO$; $C_4H_9(n)$; $C_5H_{11}(t)$ | " |

-continued
| Compound | $R_{60}$ | $R_{65}$ | $Y_4$ |
|---|---|---|---|
| M-29 | 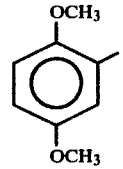 | 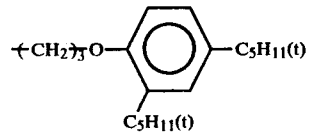 | Cl |
| M-30 | $CH_3-$ | $-CH(C_2H_5)-N(C_{18}H_{37}(n))COCH_2CH_2COOH$ | " |

(YY-1)
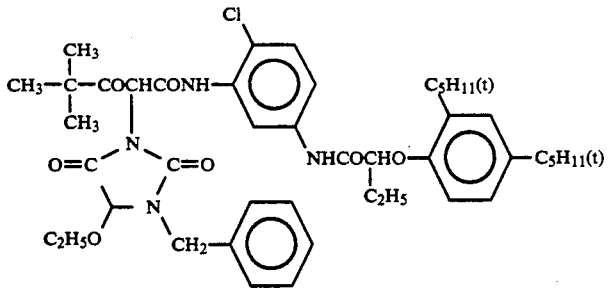
(YY-2)
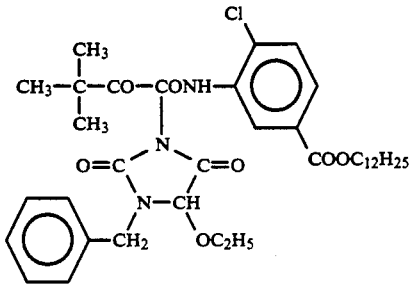
(YY-3)
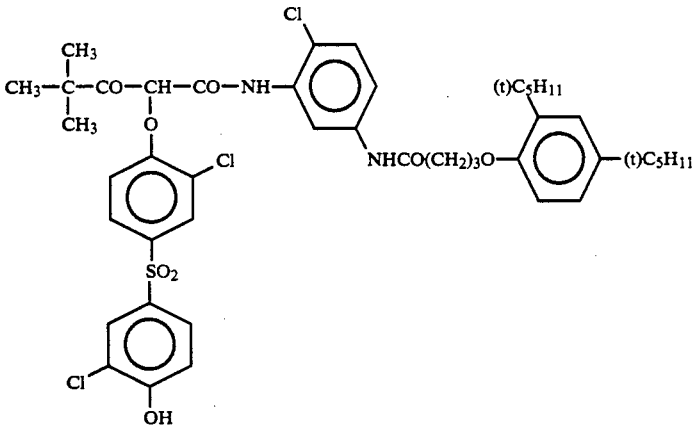
(YY-4)
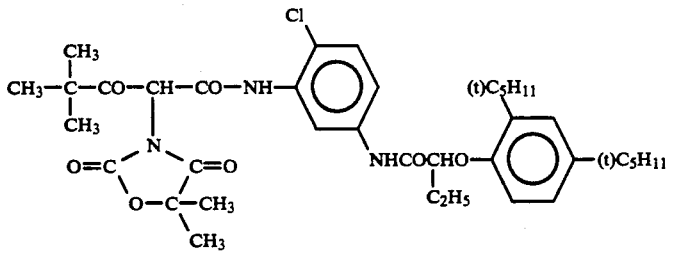
(YY-5)
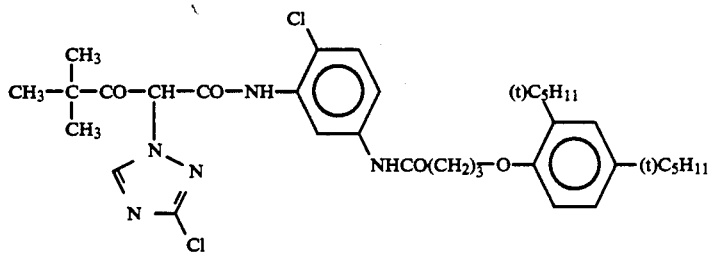

-continued
(YY-6)
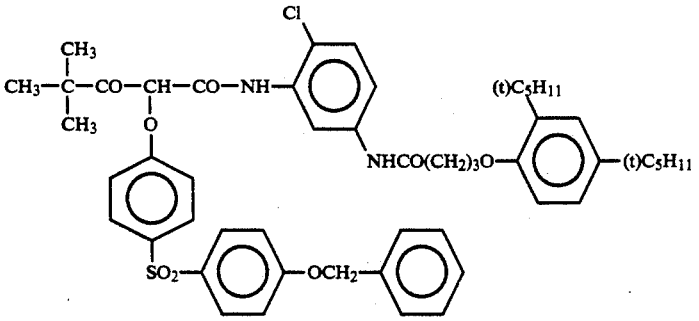
(YY-7)
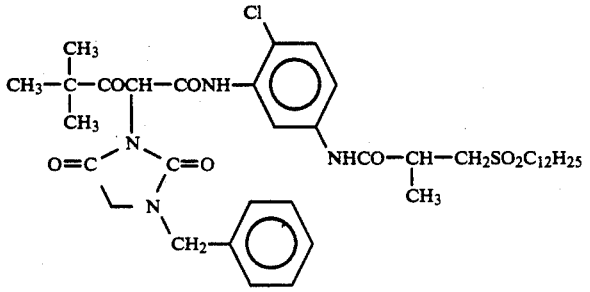
(YY-8)
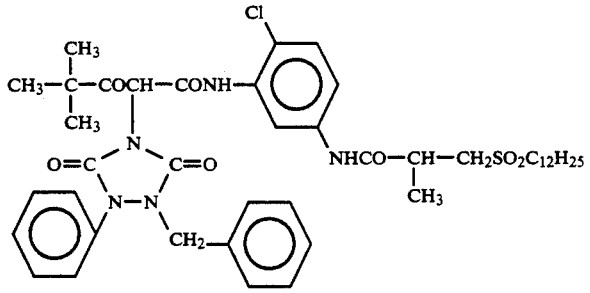
(YY-9)
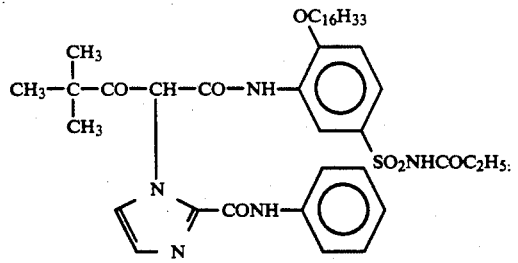
(YY-10)
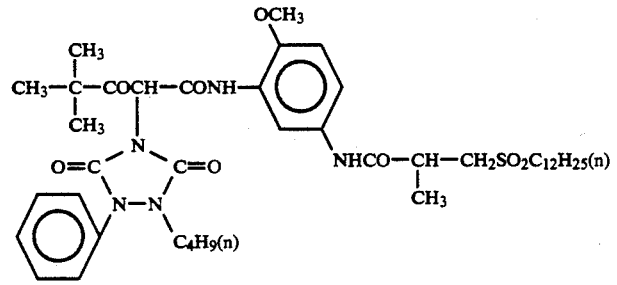

-continued (YY-11)

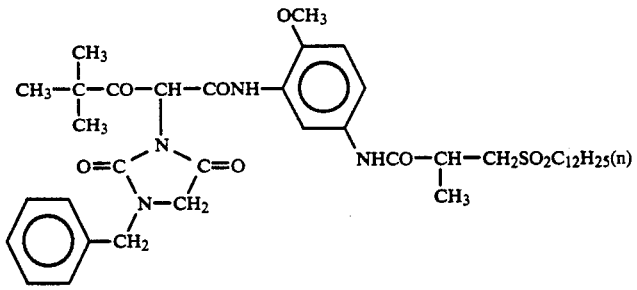

(YY-12)

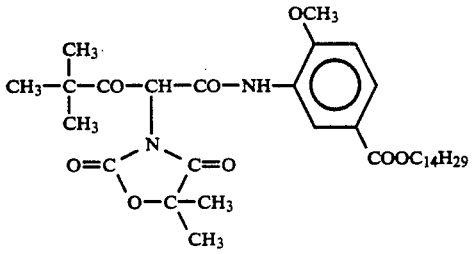

(YY-13)

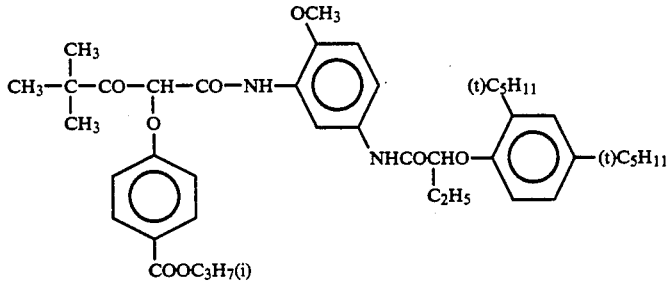

(YY-14)

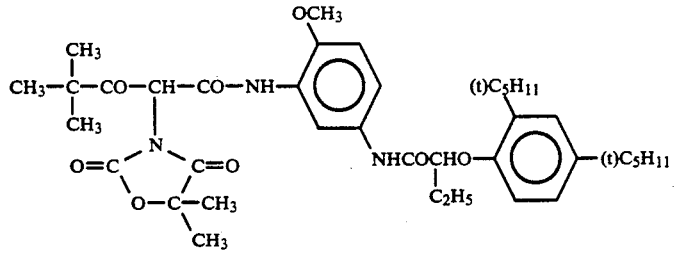

The couplers represented by the general formula (C-I) to (YY) each may be incorporated in the silver halide emulsion layers constituting the light-sensitive layer in an amount of 0.1 to 1.0 mol, preferably 0.1 to 0.5 mol per mol of silver halide.

In the present invention, to incorporate the above-mentioned couplers in the light-sensitive layer, various known methods can be used. In general, a known oil-in-water dispersion process can be used as an oil protect process to incorporate the color couplers in the light-sensitive layer. In particular, the color couplers may be emulsion-dispersed in an aqueous solution of gelatin in the form of solution in a solvent. Alternatively, water or an aqueous solution of gelatin may be added to a solution of the color coupler containing a surface active agent to cause a phase inversion so that an oil-in-water dispersion is prepared. An alkali-soluble coupler can be subjected to dispersion by a so-called Fischer's dispersion process. A low boiling organic solvent may be removed from the coupler dispersion by distillation, noodle washing process or ultrafiltration process, and then the dispersion may be mixed with a photographic emulsion.

As a dispersant for such a coupler preferably there may be used a high boiling organic solvent and/or a water-insoluble high molecular compound having a dielectric constant (at 25° C.) of 2 to 20 and a refractive index (at 25° C.) of 1.5 to 1.7.

As a high boiling organic solvent preferably there may be used a high boiling organic solvent represented by one of the general formulae (AA) to (EE):

(AA)

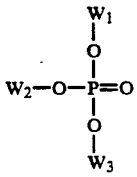

(BB)

$W_1-COO-W_2$

-continued

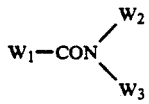

(CC)

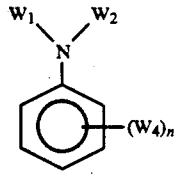

(DD)

$W_1—O—W_2$ (EE)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or $S—W_1$; and n represents an integer 1 to 5. When n is 2 or more, the plurality of $W_4$'s may be the same or different. In the general formula (EE), $W_1$ and $W_2$ may together form a condensed ring.

As high boiling organic solvents to be used in the present invention other than those represented by the general formulae (AA) to (EE) there may be used any compound having a melting point of 100° C. or lower and a boiling point of 140° C. or higher which is miscible with water and can dissolve the couplers therein. The melting point of such a high boiling organic solvent is preferably 80° C. or lower. The boiling point of the high boiling organic solvent is preferably 160° C. or higher, more preferably 170° C. or higher.

High boiling organic solvents are further described in JP-A-62-215272, lower right column on page 137 to upper right column on page 144.

Furthermore, the couplers can be emulsion-dispersed in an aqueous solution of a hydrophilic colloid in the form of impregnation in a loadable latex polymer (as described in U.S. Pat. No. 4,203,716) or a solution in a water-insoluble and organic solvent-soluble polymer in the presence or absence of the above-mentioned high boiling organic solvent.

Preferably, single polymers or copolymers as disclosed in International Patent Disclosure W088/00723, pp. 12–30, may be used. In particular, methacrylate or acrylamide polymers preferably may be used in view of dye image stability.

The light-sensitive material prepared according to the present invention may comprise as a color fogging inhibitor, a hydroquinone derivative, aminophenol derivative, gallic acid derivative, ascorbic acid derivative or the like.

The light-sensitive material of the present invention can comprise various discoloration inhibitors. Typical examples of organic discoloration inhibitors for cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and ether or ester derivatives obtained by silylating or alkylating the phenolic hydroxyl group in the compounds. Metal complexes such as (bissalicylaldoximate)nickel complex and (bis-N,N-dialkyldithicarbamate)nickel complex also may be used.

Specific examples of organic discoloration inhibitors are described in the following patents:

Specific examples of hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028, and in British Patent 1,363,921. Specific examples of 6-hydroxychromans, 5-hydroxycoumarans and spirochromans are described in U.S. Pat. Nos. 3,432,300, 3,573,050, 3,574,627, 3,698,909 and 3,764,337, and in JP-A-52-152225. Specific examples of spiroindans are described in U.S. Pat. No. 4,360,589. Specific examples of p-alkoxyphenols are described in U.S. Pat. No. 2,735,765, in British Patent 2,066,975, in JP-A-59-10539 and in JP-B-57-19765 (the term "JP-B" as used herein means an "examined Japanese patent publication"). Specific examples of hindered phenols are described in U.S. Pat. Nos. 3,700,455 and 4,228,235, in JP-A-52-72224 and in JP-B-52-6623. Specific examples of gallic acid derivatives, methylenedioxybenzenes and aminophenols are described in U.S. Pat. Nos. 3,457,079 and 4,332,886, and in JP-B-56-21144. Specific examples of hindered amines are described in U.S. Pat. Nos. 3,336,135 and 4,268,593, in British Patents 1,326,889, 1,354,313 and 1,410,846, in JP-B-51-1420 and in JP-A-58-114036, JP-A-59-53846 and JP-A-59-78344. Specific examples of metal complexes are described in U.S. Pat. Nos. 4,050,938 and 4,241,155 and in British Patent 2,027,731(A). The compounds can be incorporated in the light-sensitive material in the form of a co-emulsion with the respective corresponding color coupler in an amount of 5 to 100% by weight based thereon to accomplish the objects of the present invention. To inhibit the deterioration of cyan dye images due to heat, particularly light, it is effective to incorporate an ultraviolet absorbent in the cyan color layer and both its adjacent layers.

As such an ultraviolet absorbent there may be used a benzotriazole compound substituted by an aryl group (as described in U.S. Patent 3,533,794), 4-thiazolidone compound (as described in U.S. Pat. Nos. 3,314,794 and 3,352,681), benzophenone compound (as described in JP-A-46-2784), cinnamic ester compound (as described in U.S. Pat. Nos. 3,705,805 and 3,707,395), butadiene compound (as described in U.S. Pat. No. 4,045,229) or benzoxazole compound (as described in U.S. Pat. Nos. 3,406,070, 3,677,672 and 4,271,307). Alternatively, ultraviolet-absorbing couplers (e.g., α-naphtholic cyan dye-forming coupler) or ultraviolet-absorbing polymers can be used. The ultraviolet absobents may be mordanted in specific layers.

Particularly preferred among the ultraviolet absorbents are the above-mentioned benzotriazole compounds substituted by an aryl group.

The above-mentioned couplers may be used in combination with the following compounds, particularly pyrazoloazole couplers.

In particular, a compound (F) which undergoes chemical bonding with an aromatic amine developing agent left after color development to produce a chemically inert and substantially colorless compound and/or a compound (G) which undergoes chemical bonding with an oxidation product of an aromatic amine developing agent left after color development to produce a chemically inert and substantially colorless compound can be used at the same time with or separately from the couplers to inhibit stain and other side reactions due to the production of colored dyes caused by the reaction of the couplers with the color developing agent or oxidation product thereof left in the film during storage after processing.

As Compound (F) preferably there may be used a compound which undergoes a second order reaction with panisidine in trioctyl phosphate at a temperature of 80° C. at a rate $K_2$ of 1.0 l/mol·sec to $1\times10^{-5}$ l/mol·sec. The second order reaction rate can be determined by the method as described in JP-A-63-158545.

If $K_2$ is greater than the above-noted range, the compound becomes unstable itself, reacting with gelatin or water to decompose itself. On the other hand, if $K_2$ is smaller than that range, the compound may react slowly with the residual aromatic amine developing agent, making it impossible to inhibit side reactions of the residual aromatic amine developing agent.

Preferred examples of Compound (F) can be represented by the general formulae (FI) and (FII):

$$R_{71}-(AI)_n-X \quad \text{(FI)}$$

$$R_{72}-\underset{\underset{B}{|}}{C}=YI \quad \text{(FII)}$$

wherein $R_{71}$ and $R_{72}$ each represents an aliphatic group, aromatic group or heterocyclic group; n represents an integer 0 or 1; AI represents a group which reacts with an aromatic amine developing agent to form a chemical bond; X represents a group releasable upon reaction with an aromatic amine developing agent; B represents a hydrogen atom, aliphatic group, aromatic group, heterocyclic group, acyl group or sulfonyl group; and YI represents a group which accelerates the addition of an aromatic amine developing agent to the compound represented by the general formula (FII). $R_{71}$ and X, or YI and $R_{72}$ or B may be connected to each other to form a cyclic structure.

Typical examples of the process by which AI or B undergoes chemical bonding with the residual aromatic amine developing agent include subsubstitution reaction and addition reaction.

Specific preferred examples of the compounds represented by the general formulae (FI) and (FII) include those described in JP-A-62-158545 and JP-A-62-283338, and in European Patent Nos. 298321A and 277589A.

Preferred examples of Compound (G) which undergoes chemical bonding with an oxidation product of an aromatic amine developing agent left after color development to produce a chemically inert and substantially colorless compound can be represented by the general formula (GI):

$$R_{66}-ZZ \quad \text{(GI)}$$

wherein $R_{66}$ represents an aliphatic, aromatic or heterocyclic group; and ZZ represents a nucleophilic group or a group which decomposes in the light-sensitive material to release a nucleophilic group. The compound represented by the general formula (GI) is preferably a group having Pearson's nucleophilic $^nCH_3I$ value [R. G. Pearson, "Journal of American Society", 90, 319 (1968)] of 5 or more or a group derived therefrom.

Specific preferred examples of the compounds represented by general formula (GI) include those described in European Patent Disclosure Nos. 255722, 98321 and 277589, in JP-A-62-143048 and JP-A-62-229145, and in Japanese Patent Application Nos. 63-136724 and 62-214681.

The combination of Compound (G) and Compound (F) is described further in European Patent Disclosure No. 277589.

The light-sensitive material prepared according to the present invention may comprise a water-soluble dye or a dye which becomes water-soluble after photographic processing in the hydrophilic colloidal layer as filter layer or for the purpose of inhibiting irradiation or halation or other various purposes. Useful examples of such a dye include oxonol dye, hemioxonol dye, styryl dye, melocyanine dye, cyanine dye and azo dye. Particularly useful among the dyes are oxonol dye, hemioxonol dye and melocyanine dye.

As binders or protective colloids to be incorporated in the emulsion layer in the light-sensitive material of the present invention, gelatin can be used advantageously. Other hydrophilic colloids can be used singly or in combination with gelatin.

As gelatin to be used in the present invention there can be used lime-treated gelatin or acid-treated gelatin. The preparation of gelatin is further described in Arthur Vice, "The Macromolecular Chemistry of Gelatin", Academic Press, 1964.

As a support to be used in the present invention there can be a transparent film such as cellulose nitrate film and polyethylene terephthalate commonly used in photographic light-sensitive materials or reflective support. For the objects of the present invention, reflective support materials preferably are used.

The term "reflective support" as used herein means a material which improves reflectivity to make dye images formed on the silver halide emulsion layer clear. Examples of such a reflective support include materials coated with a hydrophobic resin comprising a light reflecting substance such as titanium oxide, zinc oxide, calcium carbonate and calcium sulfate dispersed therein and materials comprising a hydrophobic resin comprising a light relfecting substance dispersed therein. Examples of such materials include baryta paper, polyethylene-coated paper, polypropylene synthetic paper, transparent support such as glass plate comprising a reflective layer or reflective substance, polyester film such as polyethylene terephthalate, cellulose triacetate and cellulose nitrate, polyamide film, polycarbonate film, polystylene film and vinyl chloride resin.

Other examples of reflective supports which can be used include supports having a metallic surface with mirror-like reflection or the second type diffusion reflection. The metallic surface preferably has a spectral reflectance of 0.5 or more in the visible wavelength range. Alternatively, the metallic surface may be roughened or provided with metallic powder to exhibit diffused reflectivity. As the metal there can be used aluminum, tin, silver, magnesium or alloy thereof. The surface of the support may be a metal plate, metal foil or thin metal layer obtained by rolling, vacuum deposition or plating. In particular, a metal is preferably vacuum-deposited on other substrates to obtain such a metallic surface. On such a metallic surface preferably is provided a water-resistant resin layer, particularly a thermoplastic resin layer. On the surface opposite the metallic surface preferably is provided an antistatic layer. The supports are described further in JP-A-61-210346, JP-A-63-24247, JP-A-63-24251 and JP-A-63-24255.

The supports can be selected properly depending on the purpose of application.

As the light reflecting substance there can be used a white pigment which has been kneaded thoroughly in the presence of a surface active agent. The surface of the pigment preferably is treated with a divalent, trivalent or tetravalent alcohol before use.

The specified percentage area of fine white pigment grains occupied per unit area can be determined most normally by dividing the observed area into adjacent 6 $\mu m \times 6$ $\mu m$ unit areas and then measuring the percentage area of grains projected on the unit area (%) ($R_i$). The fluctuation of the percentage occupied area (%) can be determined by the ratio ($s/\overline{R}$), wherein the R is the average of $R_i$, i.e.($\overline{R}$), and s is the standard deviation of $R_i$. The number (n) of unit areas to be measured is preferably 6 or more. Accordingly, $s/\overline{R}$ can be represented by the following equation:

$$s/R = \sqrt{\frac{\sum_{i=1}^{n} (Ri - \overline{R})^2}{n-1}} \Big/ \frac{\sum_{i=1}^{n} Ri}{n}$$

In the present invention, the fluctuation of the percentage occupied area (%) of fine pigment grains is preferably in the range of 0.15 or less, particularly 0.12 or less. When the fluctuation value is 0.08 or less, the grains can be said to have a substantially "uniform" dispersibility.

The color developing solution to be used in the development of the present light-sensitive material is preferably an alkaline aqueous solution containing as a main component an aromatic primary amine color developing agent. As such a color developing agent there can be used effectively an aminophenolic compound. In particular, p-phenylenediamine compounds preferably are used. Typical examples of such p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-$\beta$-methanesulfonamideethylaniline, 3-methyl-4-amino-N-ethyl-$\beta$-methoxyethylaniline and sulfates, hydrochlorides and p-toluenesulfonates thereof. Particularly preferred among the compounds is 3-methyl-4-amino-N-ethyl-N-$\beta$-hydroxyethylaniline sulfate. The compounds can be used in combination of two or more thereof depending on the purpose of application.

The color developing solution normally contains a pH buffer such as carbonate and phosphate of alkaline metal or a development inhibitor or fog inhibitor such as bromides, iodides, benzimidazoles, benzothiazoles and mercapto compounds. If desired, the color developing solution may further contain various preservatives, e.g., hydroxylamine, diethylhydroxylamine, hydrazine sulfites, phenylsemicarbazides, triethanolamine and catecholsulfonic acids; organic solvents, e.g., ethylene glycol and diethylene glycol; development accelerators, e.g., benzyl alcohol, polyethylene glycol, quaternary ammonium salts and amines; color-forming couplers; competing couplers; auxiliary developing agents, e.g., 1-phenyl-3-pyrazolidone; viscosity-imparting agents; various chelating agents exemplified by aminopolycarboxylic acids, aminopolyphosphoric acids, alkylphosphonic acids and phosphonocarboxylic acids, e.g., ethylenediaminetetraacetic acid, nitrilotriacetic acid, diethylenetriaminepentaacetic acid, cyclohexanediamine-tetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

Reversal processing usually is carried out by black-and-white development followed by color development. Black-and-white developing solutions to be used can contain one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developing solution usually has a pH of from 9 to 12. The replenishment rate of the developing solution is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air-oxidation of the liquid. The area of the liquid surface in contact with air can be represented by the opening rate efined as follows:

Opening rate = Area of liquid surface in contact with air ($cm^2$)/volume of liquid ($cm^3$)

The opening rate is preferably in the range of 0.1 or less, more preferably 0.001 to 0.05. The reduction of the opening rate can be accomplished by providing a cover, such as floating cover on the surface of a photographic processing solution in the processing tank, or by a process which comprises the use of a mobile cover as described in JP-A-1-82033, or a slit development process as described in JP-A-63-216050. The reduction of the opening rate can be applied not only to both the color development and black-and-white development but also to the subsequent steps such as bleach, blix, fixing, rinse and stabilization. The replenishment rate also can be reduced by a means for suppressing accumulation of the bromide ion in the developing solution.

The color development time normally is selected between 2 and 5 minutes. The color development time can be reduced further by carrying out color development at an elevated temperaure and a high pH value with a color developing solution containing a color developing agent in a high concentration.

The photographic emulsion layer which has been color-developed normally is subjected to bleach. Bleach may be effected simultaneously with fixation (i.e., blix) or the two steps may be carried out separately. For expediting processing, bleach may be followed by blix. Further, any of an embodiment wherein two blix baths connected in series are used, an embodiment wherein blix is preceded by fixation and an embodiment wherein blix is followed by bleach may be selected arbitrarily according to the purpose. Bleaching agents to be used include compounds of polyvalent metals, e.g., iron (III). Typical examples of the bleaching agents are organic complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid, malic acid etc. Ferricaminopolycarboxylate complex such as ferric(ethylenediaminetetraacetato]complex and ferric(1,3-diaminopropanetetraacetato) complex are preferred in view of expediting processing and conservation of the environment. In particular, ferricaminopolycarboxylate complex are useful in both of a bleaching solution and a blix solution. The bleaching or blix solution comprising such a ferricaminopolycarboxylate complex normally has a pH value of 4.0 to 8.0. For expediting processing, it is possible to adopt a lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, in West German Patents 1,290,812 and 2,059,988, in JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426 and in Research Disclosure No. 17129 (Jul. 1978); thiazolidine derivatives as described in JP-A-50-140129; thiourea derivatives as described in U.S. Pat. No. 3,706,561; iodides as described in JP-A-58-16235, polyoxyethylene compounds as described in West German Patents 966,410 and 2,748,430; polyamine compounds as described in JP-B-45-8836; compounds as described in JP-A-49-40943, JP-A-49-59644, JP-A-53-94927, JP-A-54-35727, JP-A-55-26506 and JP-A-58-163940, and bromide ions. Preferred among the compounds are those containing a mercapto group or disulfide group because of their great acceleratory effects. In particular, the compounds disclosed in U.S. Pat. No. 3,893,858, in West German Patent 1,290,812 and in JP-A-53-95630 are preferred. The compounds disclosed in U.S. Pat. No. 4,552,834 also are preferred. The bleaching accelerators may be incorporated into the light-sensitive material. The bleaching accelerators are effective particularly for blix of color light-sensitive materials for picture taking.

In addition to the above-mentioned compounds, the bleaching solution or blix solution preferably may contain an organic acid for the purpose of inhibiting bleach stain. A particularly preferred organic acid is a compound with an acid dissociation constant (pKa) of 2 to 5. Specific preferred examples of such a compound include acetic acid and propionic acid.

Examples of fixing agents to be incorporated in the fixing solution or blix solution include thiosulfates, thiocyanates, thioethers, thioureas and a large amount of iodides. The thiosulfates normally are used, with ammonium thiosulfate being applicable most broadly. Further, thiosulfates preferably may be used in combination with thiocyanates, thioether compounds, thioureas etc. As preservatives for a fixing solution or a blix solution there preferably may be used sulfites, bisulfites, carbonyl-bisulfite adducts or sulfinic acid compounds as described in European Patent 294769A. Further, the fixing solution or blix solution preferably may comprise various aminopolycarboxylic acids or organic phosphonic acids for the purpose of stabilizing the solution.

In the present invention, a compound having a pKa value of 6.0 to 9.0, preferably imidazole such as imidazole, 1-methylimidazole, 1-ethylimidazole and 2-methylimidazole preferably may be incorporated in the fixing solution or blix solution in an amount of 0.1 to 10 mol/l to adjust the pH value thereof.

The total time required for a desilvering step may be preferably as short as possible so long as poor desilvering does not occur. The total desilvering time is preferably 1 to 3 minutes, more preferably 1 to 2 minutes. The desilvering temperature is in the range of 25° C. to 50° C., preferably 35° C. to 45° C. In the preferred temperature range, the desilvering speed is raised and the occurrence of stain after processing is inhibited effectively.

In the desilvering step, the agitation is intensified preferably as much as possible. In particular, the agitation can be intensified by various methods. For example, the processing solution may be jetted to the surface of the emulsion layer in the light-sensitive material as described in JP-A-62-183460. The agitating effect can be improved by a rotary means as described in JP-A-62-183461. Furthermore, the agitating effect can be improved by moving the light-sensitive material with the emulsion surface in contact with a wiper blade provided in the bath so that a turbulence occurs on the emulsion surface. Moreover, the agitation can be intensified by increasing the total circulated amount of processing solution. Such an agitation improving method can be effectively applied to the bleaching bath, blix bath or fixing bath. The improvement in agitation effect expedites the supply of a bleaching agent, fixing agent or the like into the emulsion film, resulting in an improvement in desilvering rate. The above-mentioned agitation improving method is more effective when a bleach accelerator is used. The agitation improving method can enhance remarkably the bleach accelerating effect or eliminate the effect of inhibiting fixation by the bleach accelerator.

The automatic developing machine to be used for the light-sensitive material of the present invention preferably is equipped with a light-sensitive material conveying means as described in JP-A-60-191257, JP-A-60-191258 and JP-A-60-191259. As described in the above-cited JP-A-60-191257, such a conveying means can reduce drastically the amount of the processing solution brought to a bath from its prebath, providing a high effect of inhibiting the deterioration of the properties of the processing solution. The effect particularly is effective for the reduction in processing time at each step or the replenishment rate of the processing solution.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers etc.), the end use of the light-sensitive material, the temperature of washing water, the number of washing tanks (number of stages), the replenishment system (e.g., countercurrent system or cocurrent system) and other various factors. Of the factors, the relationship between the number of washing tanks and the quantity of water in a multistage countercurrent system can be obtained according to the method described in "Journal of the Society of Motion Picture and Television Engineers", vol. 64, pp. 248—253 (May 1955).

According to the multi-stage countercurrent system described in the above reference, although the requisite amount of water can be reduced greatly, bacteria would grow due to an increase of the retention time of water in the tank and floating masses of bacteria stick to the light-sensitive material. In the present invention, to cope with the problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole and bactericides described in Hiroshi Horiguchi, "Bokinbobaizai no kagaku", Eisei Gijutsu Gakkai (e.), 1982, "Biseibutsu no mekkin, sakkin, bobaigijutsu", and Nippon Bokin Bobai Gakkai (ed.), "Bokin bobaizai jiten", 1986.

The washing water has a pH value of from 4 to 9, preferably from 5 to 8. The temperature of the water and the washing time can be selected from broad ranges depending on the characteristics and end use of the light-sensitive material, but usually ranges from 15 to 45° C. in temperature and from 20 seconds to 10 minutes in time, preferably from 25° to 40° C. in temperature and from 30 seconds to 5 minutes in time. The light-sensitive material of the invention may be processed directly with a stabilizer in place of the washing step. For the stabilization, any of the known techniques as described in JP-A-57-8543, JP-A-58-14834 and JP-A-60-220345 can be used.

The aforesaid washing step may be followed by stabilization in some cases. For example, a stabilizing bath containing a dye stabilizer and a surface active agent as is used as a final bath for color light-sensitive materials for picture taking is the case. Examples of such a dye stabilizer include aldehydes such as formalin and glutaraldehyde, N-methylol compounds, hexamethylenetetramine and aldehyde sulfite adducts.

The stabilizing bath also may contain various chelating agents or fungicides.

The overflow accompanying replenishment of the washing bath and/or stabilizing bath can be reused in other steps such as desilvering.

In the processing using an automatic developing machine, if the above-mentioned processing solutions are concentrated due to evaporation, water preferably may be added to the system to correct for concentration.

The present silver halide color light-sensitive material may contain a color developing agent for the purpose of simplifying and expediting processing. Such a color developing agent preferably is used in the form of various precursors. Examples of such precursors include indoaniline compounds as described in U.S. Pat. No. 3,342,597, Schiff's base-type compounds as described in U.S. Pat. No. 3,342,599, and in Research Disclosure Nos. 14,850 and 15,159, aldol compounds as described in Research Disclosure No. 13,924, metal complexes as described in U.S. Pat. No. 3,719,492 and urethane compounds as described in JP-A-53-135628.

The present silver halide color light-sensitive material optionally may comprise various 1-phenyl-3-pyrazolidones for the purpose of accelerating color development. Typical examples of such compounds are described in JP-A-56-64339, JP-A-57-144547 and JP-A-58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

The silver halide light-sensitive material of the present invention can be applied to heat-developable light-sensitive materials as described in U.S. Pat. No. 4,500,626, in JP-A-60-133449, JP-A-59-218443 and JP-A-61-238056, and in European Patent 210,660A2.

The present invention will be described further in the following examples, but the present invention should not be construed as being limited thereto.

EXAMPLE 1

As set forth in Table 2, with a 16 wt % aqueous solution of gelatin as type specimen (Specimen 1), Specimens 2 to 13 were prepared by dissolving Compounds A1, B1, C1 and D1 in the type specimen in concentrations of 0.01% by weight, 0.1% by weight and 1.0% by weight. Experiments then were effected for comparison of their preservability. As a measure of preservability, bacteria present in 1 ml of aqueous solution of gelatin were incubated in a nutrient agar medium in an incubator at a temperature of 40° C. and then measured for the number of colonies (CFU).

TABLE 1

| | Preservative |
|---|---|
| Compound A1 | 1:1:1 (weight ratio) Mixture of: Gentamicin $C_1$ (Compound No. 10); Gentamicin $C_{1a}$ (Compound No. 11); and Gentamicin $C_2$ (Compound No. 12) |
| Compound B1 | 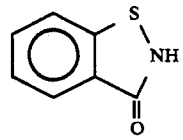 |
| Compound C1 | 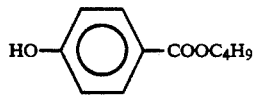 |
| Compound D1 | 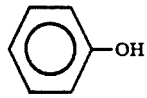 |

TABLE 2

| Specimen No. | Preservative (wt % based on gelatin) A1 | B1 | C1 | D1 |
|---|---|---|---|---|
| 1 | — | — | — | — |
| 2 | 0.01 | — | — | — |
| 3 | 0.1 | — | — | — |
| 4 | 1.0 | — | — | — |
| 5 | — | 0.01 | — | — |
| 6 | — | 0.1 | — | — |
| 7 | — | 1.0 | — | — |
| 8 | — | — | 0.01 | — |
| 9 | — | — | 0.1 | — |
| 10 | — | — | 1.0 | — |
| 11 | — | — | — | 0.01 |
| 12 | — | — | — | 0.1 |
| 13 | — | — | — | 1.0 |

TABLE 3

| Specimen No. | Criteria of bacteria 0 day | 1 day | 2 days | 3 days |
|---|---|---|---|---|
| 1 | Very poor | Very poor | Very poor | Very poor |
| 2 | Excellent | Excellent | Excellent | Excellent |
| 3 | Excellent | Excellent | Excellent | Excellent |
| 4 | Excellent | Excellent | Excellent | Excellent |
| 5 | Very poor | Very poor | Very poor | Very poor |
| 6 | Excellent | Fair | Poor | Very poor |
| 7 | Excellent | Excellent | Excellent | Excellent |
| 8 | Very poor | Very poor | Very poor | Very poor |
| 9 | Fair | Poor | Very poor | Very poor |
| 10 | Excellent | Excellent | Excellent | Excellent |
| 11 | Very poor | Very poor | Very poor | Very poor |

TABLE 3-continued

| Specimen No. | Criteria of bacteria 0 day | 1 day | 2 days | 3 days |
|---|---|---|---|---|
| 12 | Poor | Very poor | Very poor | Very poor |
| 13 | Excellent | Excellent | Excellent | Fair |

TABLE 4

| Number of bacteria (CFU) | Criteria of bacteria |
|---|---|
| 0 | Excellent |
| 1-5 | Good |
| 6-20 | Fair |
| 21-50 | Poor |
| 51 or more | Very poor |

The results are set forth in Table 3. The judgment of bacterial conditions was effected in accordance with the criteria set forth in Table 4.

Table 3 shows that the use of Compound Al as preservative can inhibit the incubation of bacteria as compared to Compounds Bl, Cl and Dl regardless of its amount, e.g., 0.01% by weight, exhibiting an excellent preserving effect.

For the evaluation of anti-fungal properties, fungi were put into Specimens 1 to 13 for proliferation. As a result, Specimens 2 to 4 showed less proliferation of fungi than Specimens 5 to 13, exhibiting high antifungal properties.

EXAMPLE 2

A polyethylene double-laminated paper support was subjected to corona discharge on the surface thereof. A gelatin subbing layer containing sodium dodecylbenzenesulfonate then was coated on the surface of the paper support thus treated. Various photographic constituent layers then were coated on the subbing layer to prepare a multi-layered color photographic paper having the following layer structure. The coating solutions for the layers were prepared as follows:

Preparation of 1st Layer Coating Solution

To 19.1 g of a yellow coupler (ExY), 4.4 g of a dye image stabilizer (Cpd-1), 4.1 g of a dye image stabilizer (Cpd-12) and 0.7 g of a dye image stabilizer (Cpd-7) were added 27.2 cc of ethyl acetate, 4.1 g of a solvent (Solv-3) and 4.1 g of a solvent (Solv-7). The solution was then emulsion dispersed in 185 cc of a 10% aqueous solution of gelatin containing 8 cc of 10% sodium dodecylbenzenesulfonate to prepare emulsified Dispersion Al. On the other hand, a silver bromochloride emulsion A (3:7 (molar ratio as calculated in terms of silver) mixture of a large size emulsion A comprising cubic grains with an average size of 0.88 μm and a grain size distribution fluctuation coefficient of 0.08 and a small size emulsion A having cubic grains with an average size of 0.70 μm and a grain size distribution fluctuation coefficient of 0.10, each emulsion having 0.3 mol % silver bromide localized on part thereof) was prepared. The emulsion comprised blue-sensitizing dyes A and B as described later in amounts of $2.0\times10^{-4}$ mol each for large size emulsion A and $2.5\times10^{-4}$ mol each for small size emulsion B, respectively. The chemical sensitization of the emulsion was effected with a sulfur sensitizer and a gold sensitizer. Emulsion Dispersion Al and the silver bromochloride emulsion A then were mixed and dissolved to prepare a 1st layer coating solution having the composition as described later.

The coating solutions for the 2nd to 7th layers were prepared in the same manner as in the 1st layer coating solution. As gelatin hardener there was added to each of the layers a sodium salt of 1-oxy-3,5-dichloro-s-triazine.

To each of the layers was added Cpd-10 and Cpd-11 in amounts of 25.0 mg/m$^2$ and 50.0 mg/m$^2$, respectively.

The silver bromochloride emulsion to be incorporated in the various light-sensitive enulsion layers comprised the following spectral sensitizing dyes:

Sensitizing Dye A for blue-sensitive emulsion layer

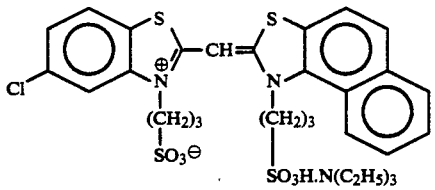

Sensitizing Dye B for blue-sensitive emulsion layer

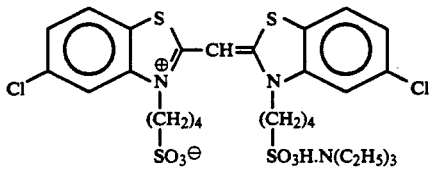

($2.0\times10^{-4}$ mol each for large size emulsion A and $2.5\times10^{-4}$ mol each for small size emulsion A per mol of silver halide)

Sensitizing Dye C for green-sensitive emulsion layer

-continued

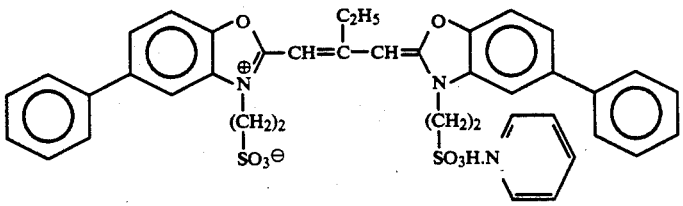

(4.0 × $10^{-4}$ mol each for large size emulsion B and 5.6 × $10^{-4}$ mol each for small size emulsion B per mol of silver halide)

Sensitizing Dye D for green-sensitve emulsion layer

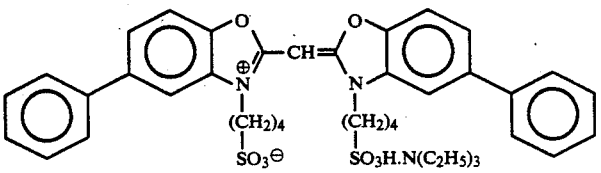

(7.0 × $10^{-5}$ mol each for large size emulsion B and 1.0 × $10^{-5}$ mol each for small size emulsion B per mol of silver halide)

Sensitizing Dye E for red-sensitive emulsion layer

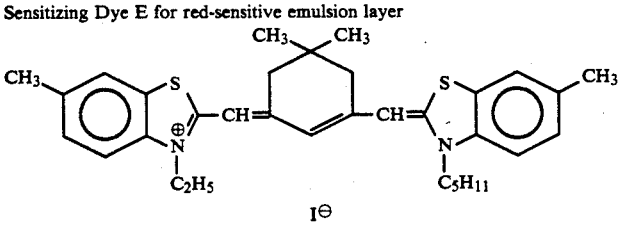

(0.9 × $10^{-4}$ mol each for large size emulsion C and 1.1 × $10^{-4}$ mol each for small size emulsion C per mol of silver halide)

To the red-sensitive emulsion layer was incorporated the following compound in an amount of $2.6\times10^{-3}$ mol per mol of silver halide:

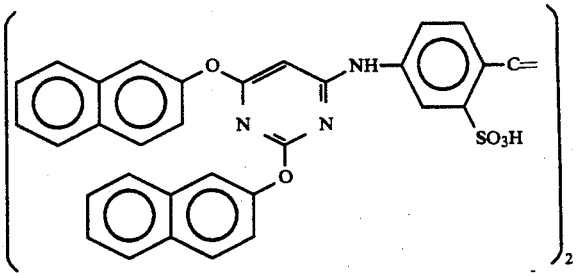

To the blue-sensitive emulsion layer, green-sensitive emulsion layer and red-sensitive emulsion layer were added 1-(5-methylureidephenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and green-sensitive emulsion layer were added 4-hydroxy-6-methyl-1,3,3a-tetrazaindene in amounts of $1\times10^{-4}$ mol and $2\times10^{-4}$ mol per mol of silver halide, respectively.

To inhibit irradiation, the following dyes were added to the emulsion layers (figure in parenthesis indicates the coated amount).

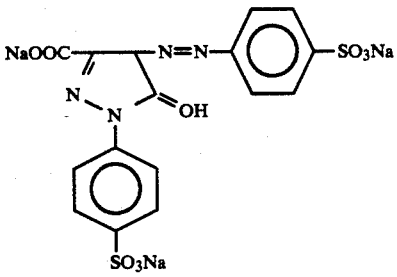

(10 mg/$m^2$)

-continued

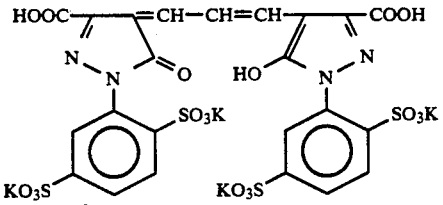

(10 mg/m²)

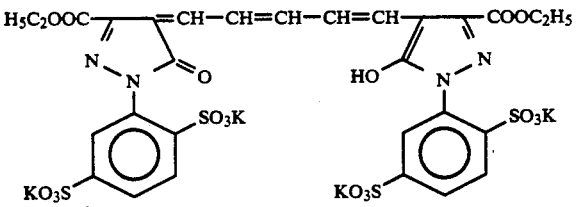

(40 mg/m²)

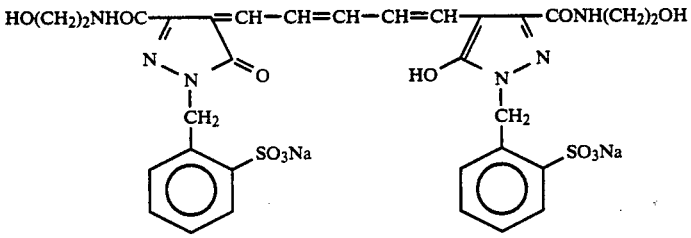

(20 mg/m²)

Layer Structure

The composition of the various layers are set forth below. The figures indicate the coated amount (g/m²). The coated amount of silver halide emulsion is represented as calculated in terms of silver.

| | |
|---|---|
| Support: | |
| Polyethylene-laminated paper (containing a white pigment ($TiO_2$) and a bluish dye (ultramarine) on the 1st layer side) | |
| 1st Layer: blue-sensitive emulsion layer | |
| Silver bromochloride emulsion A as set forth above | 0.30 |
| Gelatin | 1.86 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| 2nd Layer: color stain inhibition layer | |
| Gelatin | 0.99 |
| Color stain inhibitor (Cpd-5) | 0.08 |
| Solvent (Solv-1) | 0.16 |
| Solvent (Solv-4) | 0.08 |
| 3rd Layer: green-sensitive emulsion layer | |
| Silver bromochloride emulsion (1:3 (molar ratio as calculated in terms of silver) mixture of a large size emulsion B comprising cubic grains with an average size of 0.55 μm and a grain size distribution fluctuation coefficient of 0.10 and a small size emulsion B having cubic grains with an average size of 0.39 μm and a grain size distribution fluctuation coefficient of 0.08, each emulsion having 0.8 mol % silver bromide localized on part thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th Layer: ultraviolat-absorbing layer | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| 5th Layer: red-sensitive emulsion layer | |
| Silver bromochloride emulsion (1:4 (molar ratio as calculated in terms of silver) mixture of a large size emulsion C comprising cubic grains with an average size of 0.58 μm and | 0.23 |

-continued

| | |
|---|---|
| a grain size distribution fluctuation coefficient of 0.09 and a small size emulsion C having cubic grains with an average size of 0.45 μm and a grain size distribution fluctuation coefficient of 0.11, each emulsion having 0.6 mol % silver bromide localized on part thereof) | |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th Layer: ultraviolat-absorbing layer | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th Layer: protective layer | |
| Gelatin | 1.33 |
| Acryl-modified copolymer of polyvinyl alcohol (modification degree: 17%) | 0.17 |
| Liquid paraffin | 0.03 |

(ExY) Yellow Coupler:
1:1 Mixture (molar ratio) of:

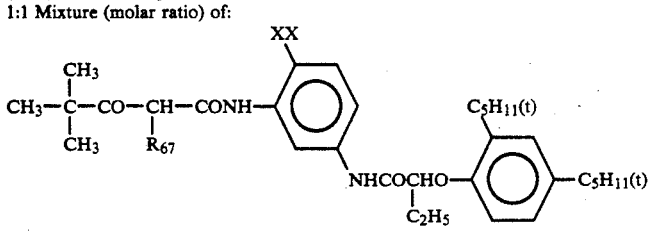

$R_{67}$ = 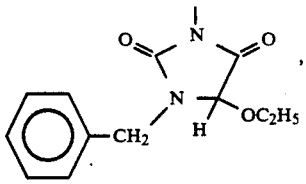 , XX = Cl and $R_{67}$ = 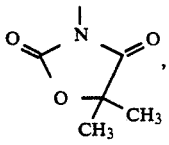 , XX = $OCH_3$ (ExM) Magenta Coupler:

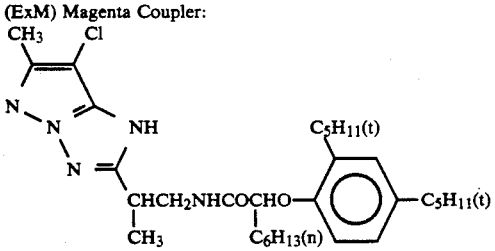

(ExC) Cyan Coupler:
1:1 Mixture (molar ratio) of:

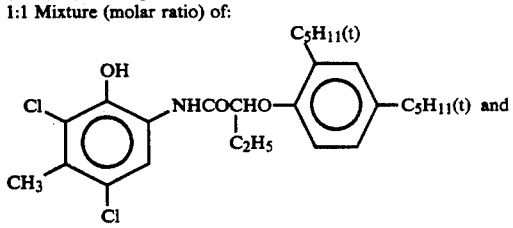

and

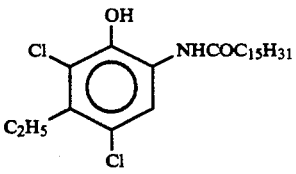

(Cpd-1) Dye Image Stabilizer:

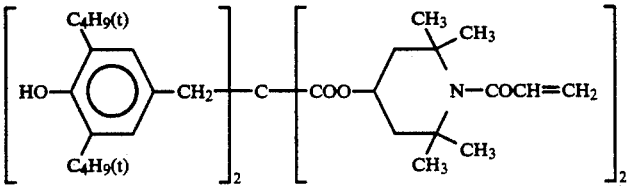

(Cpd-2) Dye Image Stabilizer:

-continued
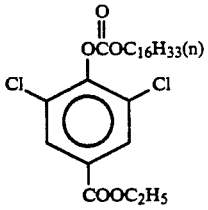
(Cpd-3) Dye Image Stabilizer:
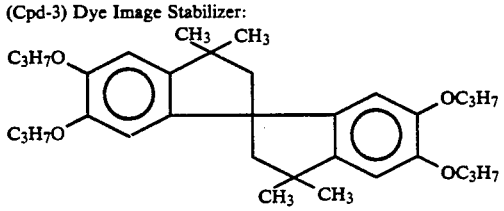
(Cpd-4) Dye Image Stabilizer:
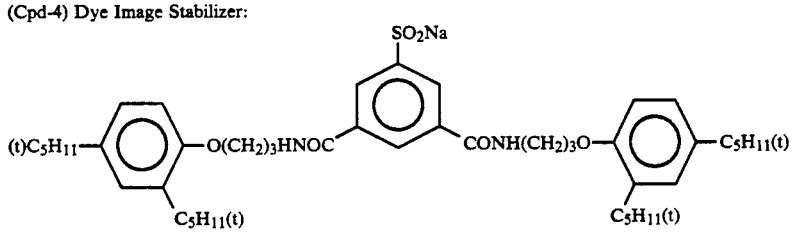
(Cpd-5) Color Stain Inhibitor
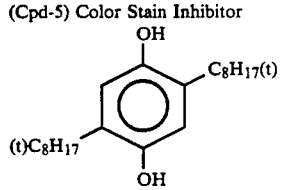
(Cpd-6) Color Image Stabilizer
2:2:4 Mixture (by weight) of:
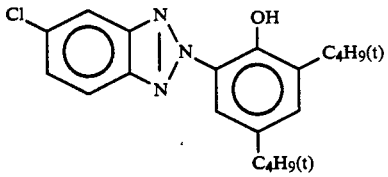
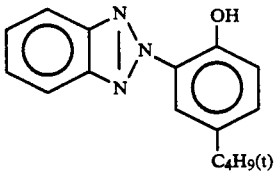
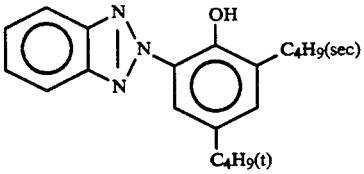
(Cpd-7) Color Image Stabilizer
$-(CH_2-CH)_n-$ (Average molecular weight: 60,000)
| CONHC4H9(t)
(Cpd-8) Dye Image Stabilizer:
1:1 Mixture (by weight) of:
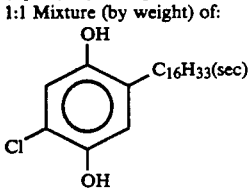
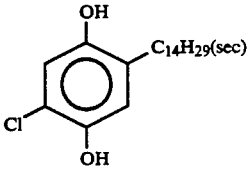
(Cpd-9) Dye Image Stabilizer:

-continued
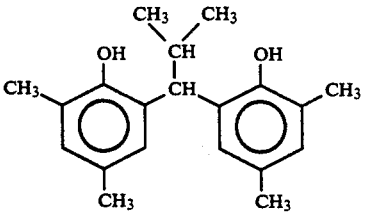
(Cpd-10) Preservative
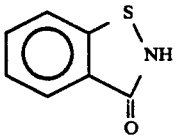
(Cpd-11) Preservative
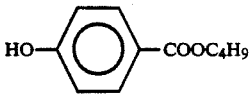
(Cpd-12) Dye image stabilizer:
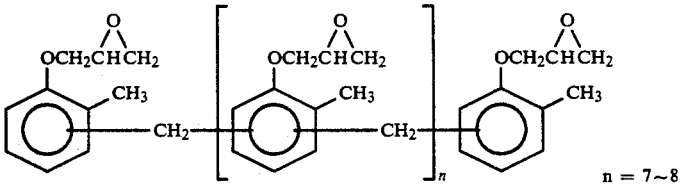
n = 7~8
(UV-1) Ultraviolet Absorbent
4:2:4 Mixture (by weight) of:
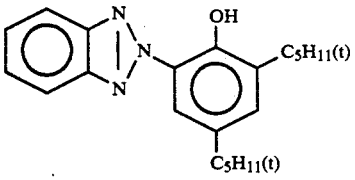
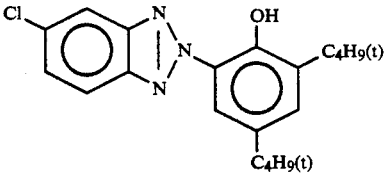
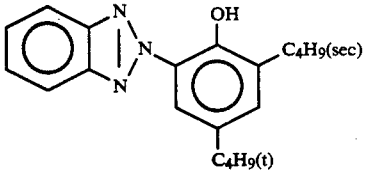
(Solv-1) Solvent:
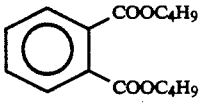
(Solv-2) Solvent:
1:1 Mixture (by volume) of:
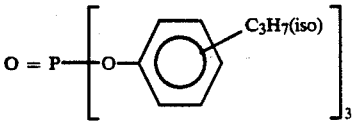
and
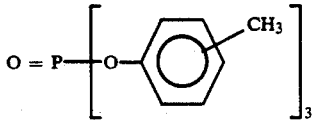
(Solv-3) Solvent:
$O = P\text{-}[O\text{-}C_9H_{19}(iso)]_3$
(Solv-4) Solvent:

-continued

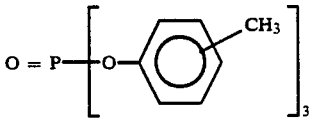

(Solv-5) Solvent:

$$\begin{array}{l} COOC_8H_{17} \\ | \\ (CH_2)_8 \\ | \\ COOC_8H_{17} \end{array}$$

(Solv-6) Solvent
80:20 Mixture (by volume) of:

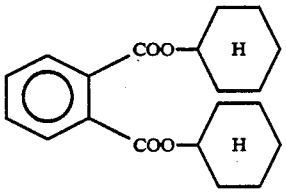

and $C_8H_{17}CH\underset{O}{\underset{\backslash /}{CH}}(CH_2)_7COOC_8H_{17}$ (Solv-7) Solvent:
$C_8H_{17}CH\underset{O}{\underset{\backslash /}{CH}}(CH_2)_7COOC_8H_{17}$ The specimen thus prepared was identified as Specimen 101. Specimen 102 was prepared in the same manner as in Specimen 101 except that a 1:1:1 (weight ratio) mixture of exemplified Compounds 10, 11 and 12 was used instead of the mixture of the preservatives Cpd-10 and Cpd-11 in an amount of 0.5 mg/m$^2$.

Specimens 101 and 102 thus prepared were examined for photographic properties in the manner as described hereinafter.

The specimens then were subjected to gradient exposure through a separation filter for sensitometry by means of a sensitometer (Model FWH; color temperature of light source: 3,200° K.; available from Fuji Photo Film Co., Ltd.). The exposure was effected in such a manner that the exposure reached 250 CMS for 0.1 second.

The specimens exposed then were subjected to continuous processing (running test) with the following processing solutions in the following processing steps by means of a paper processing machine until the replenishment reached twice the capacity of the color developer tank.

| Processing step | Temperature | Time | Replenishment rate* | Tank capacity |
|---|---|---|---|---|
| Color development | 35° C. | 45 sec. | 161 ml | 17 l |
| Blix | 30–35° C. | 45 sec. | 215 ml | 17 l |
| Rinse 1 | 30–35° C. | 20 sec. | — | 10 l |
| Rinse 2 | 30–35° C. | 20 sec. | — | 10 l |
| Rinse 3 | 30–35° C. | 20 sec. | 350 ml | 10 l |
| Drying | 70–80° C. | 60 sec. | | |

*per m$^2$ of light-sensitive material

The rinse step was effected in a countercurrent process wherein the rinse solution flows backward.

The various processing solutions had the following compositions:

Color developer

| | Running Solution | Replenisher |
|---|---|---|
| Water | 800 ml | 800 ml |
| Ethylenediamine-N,N,N',N'-tetraphosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)-hydrazine | 4.0 g | 5.0 g |
| Mono-sodium salt of N,N-di-(sulfoethyl)hydroxylamine | 4.0 g | 5.0 g |
| Fluorescent brightening agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |

Blix solution (Running solution was the same as replenisher)

| | |
|---|---|
| Water | 400 ml |
| 70% Ammonium thiosulfate | 100 ml |
| Sodium sulfite | 17 g |
| Ferric ammonium ethylenediamine-tetraacetate | 55 g |
| Disodium ethylenediaminetetraacetate | 5 g |
| Ammonium bromide | 40 g |
| Water to make | 1,000 ml |
| pH (25° C.) | 6.0 |

Rinse Solution (Running Solution was the Same as Replenisher

Ion-exchanged water (calcium and magnesium concentration: 3 ppm each).

The specimens were measured for density to determine the relative sensitivity of blue-sensitive layer, green-sensitive layer and red-sensitive layer.

Another batch of Specimens 101 and 102 which had not been exposed and processed were aged at a temperature of 35° C. and a relative humidity of 60% for 1 month, subjected to the above mentioned treatment and then measured for photographic properties and sensitivity.

The results are set forth in Table 5.

TABLE 5

| Specimen No. | Relative sensitivity (B) | | Relative sensitivity (G) | | Relative sensitivity (R) | |
|---|---|---|---|---|---|---|
| | Before ageing | After ageing | Before ageing | After ageing | Before ageing | After ageing |
| 101 (comparative) | 100 | 83 | 100 | 87 | 100 | 82 |
| 102 (present invention) | 99 | 89 | 100 | 91 | 98 | 89 |

Table 5 shows that the specimen of the present invention exhibits little drop in the sensitivity even after untreated ageing.

EXAMPLE 3

A multi-layered color photographic paper was prepared by coating various layers having the following structures on a polyethylene double-laminated paper support. The coating solutions for the layers were prepared as follows:

Preparation of 1st Layer Coating Solution

To 19.1 g of a yellow coupler (ExY), 3.8 g of a dye image stabilizer (Cpd-1) and 1.9 g of a dye image stabilizer (Cpd-7) were added 27.2 cc of ethyl acetate, 3.8 g of a solvent (Solv-3) and 3.8 g of a solvent (Solv-6). The solution was then emulsion dispersed in cc of a 10% aqueous solution of gelatin containing 8 cc of 10% sodium dodecylbenzenesulfonate to prepare Emulsion Dispersion A2. On the other hand, to a silver bromochloride emulsion (1 : 4 (molar ratio as calculated in terms of silver) mixture of a sulfur-sensitized emulsion comprising cubic grains with a silver bromide content of 80.0 mol %, an average size of 0.85 μm and a grain size distribution fluctuation coefficient of 0.08 and a sulfur-sensitized emulsion having cubic grains with a silver bromide content of 80.0 mol %, an average size of 0.62 μm and a grain size distribution fluctuation coefficient of 0.07) was added the following blue-sensitive sensitizing dye in an amount of $5.0\times10^{-4}$ mol per mol of silver. The previously prepared emulsion dispersion A2 and the silver bromochloride emulsion thus prepared were mixed to prepare a 1st layer coating solution having the composition described later.

The coating solutions for the 2nd to 7th layers were prepared in the same manner as in the 1st layer coating solution. As gelatin hardener there was added to each of these layers sodium salt of 1-oxy-3,5-dichlorostriazine.

The silver bromochloride emulsion to be incorporated in the various light-sensitive emulsion layers comprised the following spectral sensitizing dyes:

Spectral sensitizing dye for blue-sensitive emulsion layer

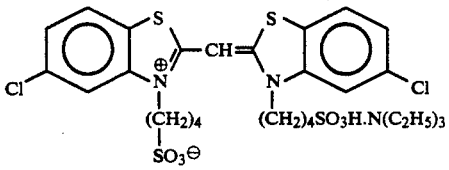

($5.0\times10^{-4}$ mol per mol of silver halide)

Spectral sensitizing dye for green-sensitive emulsion layer

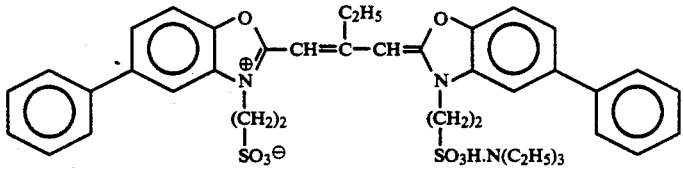

($4.0\times10^{-4}$ mol per mol of silver halide)

and

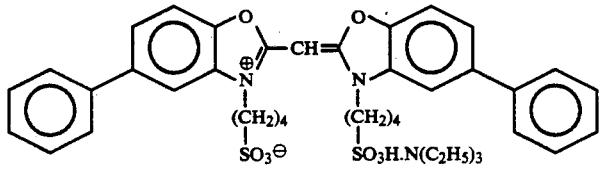

($7.0\times10^{-5}$ mol per mol of silver halide)

For Red-sensitive Emulsion Layer

-continued

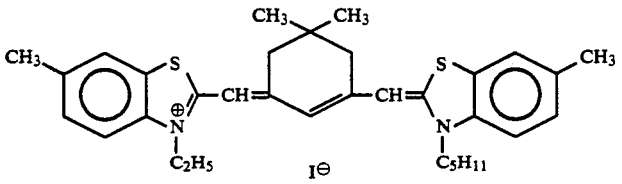

In the red-sensitive emulsion layer further was incorporated the following compound in an amount of $2.6\times10^{-3}$ mol per mol of silver halide:

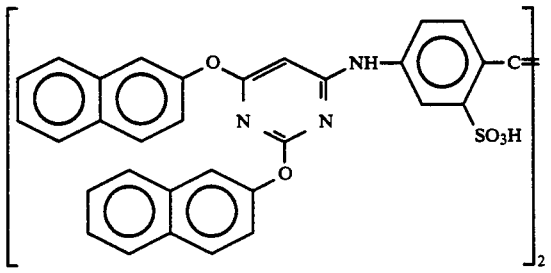

To the blue-sensitive emulsion layer, green-sensitive emulsion layer and red-sensitive emulsion layer were added 1-(5-methylureidephenyl)-5-mercaptotetrazole in amounts of $4.0\times10^{-5}$ mol, $3.0\times10^{-4}$ mol and $1.0\times10^{-4}$ mol per mol of silver halide and 2-methyl-5-t-octylhydroquinone in amounts of $8\times10^{-3}$ mol, $2\times10^{-3}$ mol and $1\times10^{-3}$ mol, respectively.

To the blue-sensitive emulsion layer and green-sensitive emulsion layer were added 4-hydroxy-6-methyl-1,3,3a-tetrazaindene in amounts of $1.2\times10^{-2}$ mol and $1.1\times10^{-2}$ mol per mol of silver halide, respectively.

To the red-sensitive emulsion layer were added the following mercaptoimidazole compound and mercaptothiadiazole compound in amounts of $2\times10^{-4}$ mol and $4\times10^{-4}$ mol per mol of silver halide, respectively.

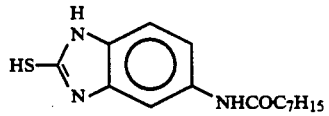

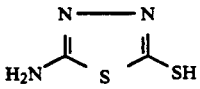

In order to inhibit irradiation, the following dyes were added to the emulsion layers.

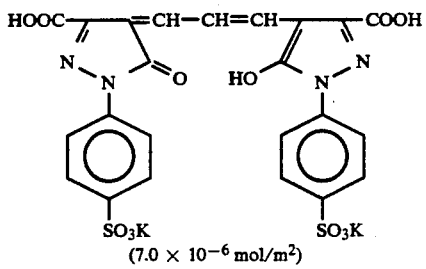

($7.0\times10^{-6}$ mol/m$^2$)

-continued

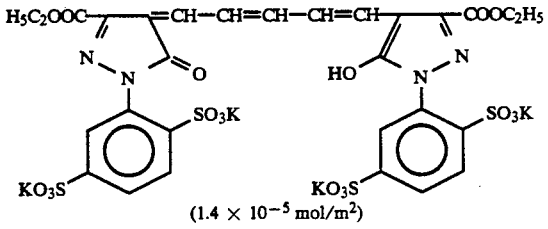

($1.4\times10^{-5}$ mol/m$^2$)

and

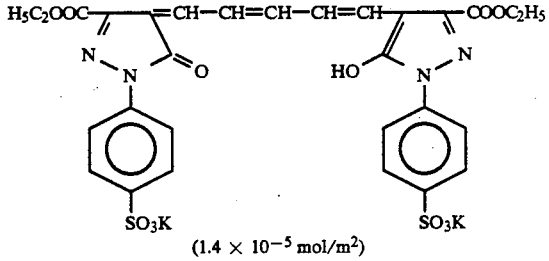

($1.4\times10^{-5}$ mol/m$^2$)

Specimens 201 and 202 were prepared in the same manner as described above except that Compounds I and II, as set forth in Table 6, were added to the emulsion.

TABLE 6

| | |
|---|---|
| Compound I 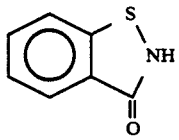 | (25 mg/m$^2$) |
| 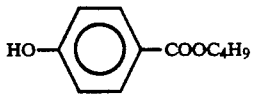 | (25 mg/m$^2$) |
| 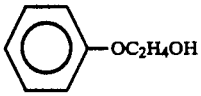 | (500 mg/m$^2$) |
| Compound II 1:1:1 (weight ratio) mixture of Gentamicins $C_1$, $C_{1a}$ and $C_{2a}$ | (0.5 mg/m$^2$) |

Layer Structure

The composition of the various layers are set forth below. The figures indicate the coated amount (g/m$^2$). The coated amount of silver halide emulsion is represented as calculated in terms of silver.

| | |
|---|---|
| Support: | |
| Polyethylene-laminated paper (containing a white pigment ($TiO_2$) in an amount of 14.5% by weight and a bluish dye (ultramarine) in an amount of 0.3% by weight on the 1st layer side) | |
| 1st Layer: blue-sensitive emulsion layer | |
| Silver bromochloride emulsion (AgBr: 80 mol %) as set forth above | 0.30 |
| Gelatin | 1.15 |
| Yellow coupler (ExY) | 0.68 |
| Dye image stabilizer (Cpd-1) | 0.14 |
| Dye image stabilizer (Cpd-7) | 0.07 |
| Solvent (Solv-3) | 0.14 |
| Solvent (Solv-6) | 0.14 |
| 2nd Layer: color stain inhibiting layer | |
| Gelatin | 1.34 |
| Color stain inhibitor (Cpd-5) | 0.04 |
| Solvent (Solv-1) | 0.10 |
| Solvent (Solv-4) | 0.10 |
| 3rd Layer: green-sensitive emulsion layer | |
| Silver bromochloride emulsion (1:1 (molar ratio as calculated in terms of silver) mixture of an emulsion comprising cubic grains with an AgBr content of 90 mol %, an average size of 0.47 μm and a grain size distribution fluctuation coefficient of 0.12 and an emulsion comprising cubic grains with an AgBr content of 90 mol %, an average size of 0.36 μm and a grain size distribution fluctuation coefficient of 0.09) | 0.13 |
| Gelatin | 1.48 |
| Magenta coupler (ExM) | 0.27 |
| Dye image stabilizer (Cpd-2) | 0.04 |
| Dye image stabilizer (Cpd-3) | 0.20 |
| Dye image stabilizer (Cpd-4) | 0.01 |
| Dye image stabilizer (Cpd-8) | 0.03 |
| Dye image stabilizer (Cpd-9) | 0.08 |
| Solvent (Solv-2) | 0.65 |
| 4th Layer: ultraviolet-absorbing layer | |
| Gelatin | 1.44 |
| Ultraviolet absorbent (UV-1) | 0.52 |
| Color stain inhibitor (Cpd-5) | 0.06 |
| Solvent (Solv-5) | 0.26 |
| 5th Layer: red-sensitive emulsion layer | |
| Silver bromochloride emulsion (1:2 (molar ratio as calculated in terms of silver) mixture of an emulsion comprising cubic grains with an AgBr content of 70 mol %, an average size of 0.49 μm and a grain size distribution fluctuation coefficient of 0.08 and an emulsion comprising cubic grains with an AgBr content of 70 mol %, an average size of 0.34 μm and a grain size distribution fluctuation coefficient of 0.10) | 0.20 |
| Gelatin | 0.85 |
| Cyan coupler (ExC) | 0.28 |
| Dye image stabilizer (Cpd-6) | 0.56 |
| Dye image stabilizer (Cpd-7) | 0.27 |
| Dye image stabilizer (Cpd-8) | 0.02 |
| Dye image stabilizer (Cpd-9) | 0.02 |
| Solvent (Solv-6) | 0.17 |
| 6th Layer: ultraviolet-absorbing layer | |
| Gelatin | 0.39 |
| Ultraviolet absorbent (UV-1) | 0.16 |
| Color stain inhibitor (Cpd-5) | 0.02 |
| Solvent (Solv-5) | 0.08 |
| 7th Layer: protective layer | |
| Gelatin | 1.26 |
| Acryl-modified copolymer of polyvinyl alcohol (modification degree: 17%) | 0.05 |
| Liquid paraffin | 0.02 |

(Cpd-1) Dye Image Stabilizer:

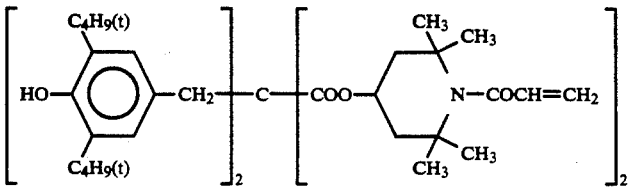

(Cpd-2) Dye Image Stabilizer:

-continued
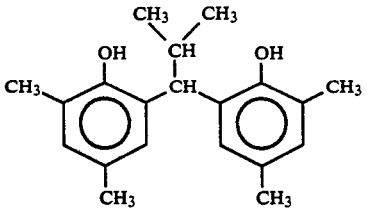
(Cpd-3) Dye Image Stabilizer:
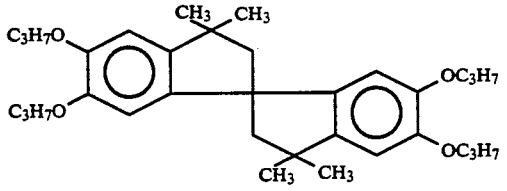
(Cpd-4) Dye Image Stabilizer:
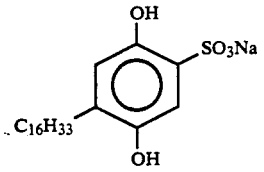
(Cpd-5) Color Stain Inhibitor:
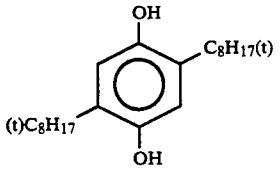
(Cpd-6) Dye Image Stabilizer:
2:2:4 Mixture (by weight) of:
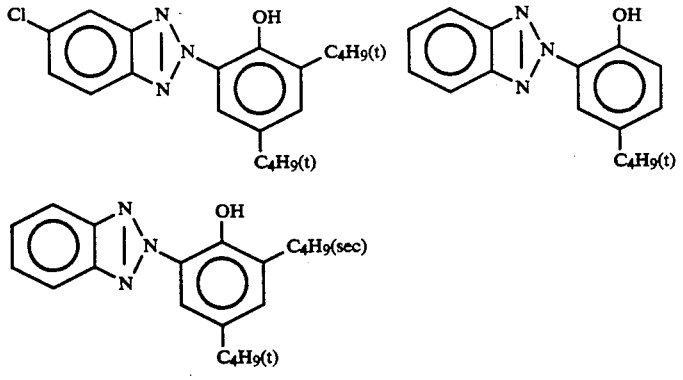
(Cpd-7) Dye Image Stabilizer:
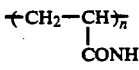
(Average molecular weight 80,000)
(Cpd-8) Dye Image Stabilizer:

-continued
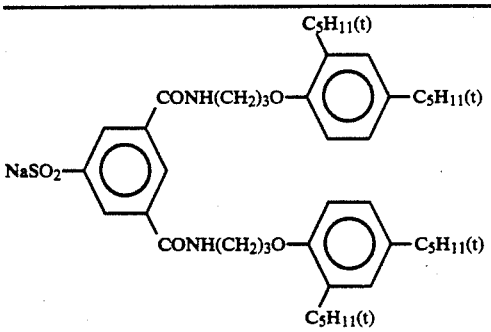
(Cpd-9) Dye Image Stabilizer:
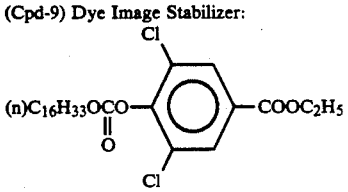
(UV-1) Ultraviolet Absorbent
4:2:4 Mixture (by weight) of:
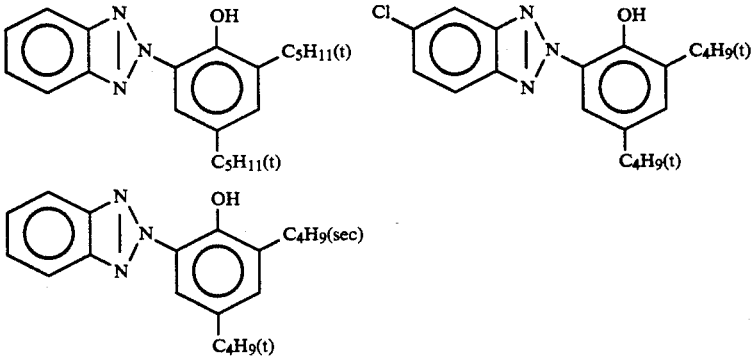
(Solv-1) Solvent:
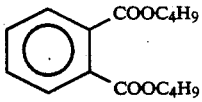
(Solv-2) Solvent:
2:1 Mixture (by weight) of:
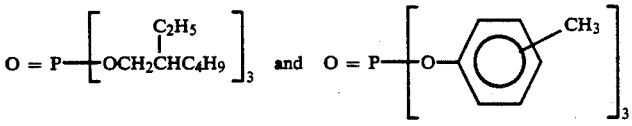
(Solv-3) Solvent:
$O = P\text{-}[O\text{-}C_9H_{19}(iso)]_3$
(Solv-4) Solvent:
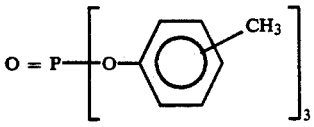
(Solv-5) Solvent
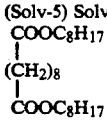
(Solv-6) Solvent:

-continued $C_8H_{17}CHCH(CH_2)_7COOC_8H_{17}$
O (ExY) Yellow Coupler:
1:1 Mixture (mol ratio) of:

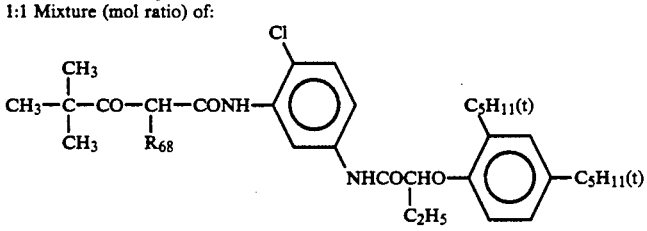

$R_{68}$ = 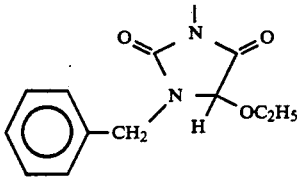 and $R_{68}$ = 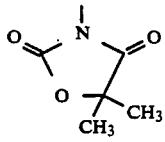

(ExM) Magenta Coupler:
1:1 Mixture (molar ratio) of:

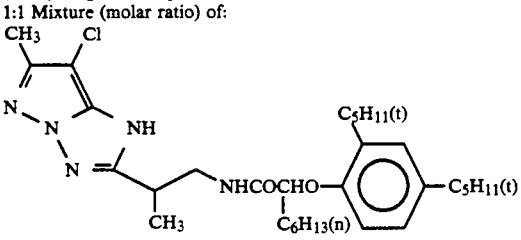

and

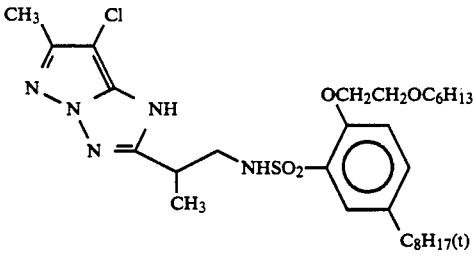

(ExC) Cyan Coupler:
1:1 Mixture (molar ratio) of:

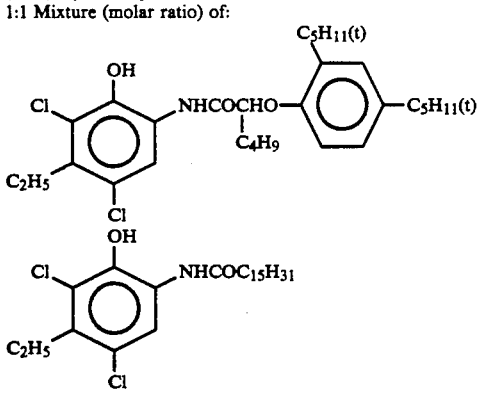

The specimens then were subjected to gradient exposure through a separation filter for sensitometry by means of a sensitometer (Model FWH; color temperature of light source: 3,200° K.; available from Fuji Photo Film Co., Ltd.). The exposure was effected in such a manner that the exposure reached 250 CMS for 0.1 second.

The specimens exposed then were subjected to processing with the following processing solutions in the following processing steps by means of a paper processing machine.

| Processing step | Temperature | Time |
|---|---|---|
| Color development | 37° C. | 3 min. 30 sec. |
| Blix | 33° C. | 1 min. 30 sec. |
| Rinse | 24–34° C. | 3 min. |
| Drying | 70–80° C. | 1 min. |

The various processing solutions had the following compositions:

| | |
|---|---|
| Color developer | |
| Water | 800 ml |
| Dithylenediaminepenta-acetic acid | 1.0 g |
| Nitrilo-triacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-ethyl-N-(β-methanesul-fonamidoethyl)-3-methyl-4-aminoaniline sulfate | 4.5 g |
| Hydroxylamine sulfate | 3.0 g |
| Fluorescent brightening agent (WHITEX 4B, available from Sumitomo Chemical Co., Ltd.) | 1.0 g |
| Water to make | 1,000 ml |
| pH (25° C.) | 10.25 |
| Blix solution | |
| Water | 400 ml |
| Ammonium thiosulfate (700 g/l) | 150 ml |
| Sodium sulfite | 18 g |
| Ferric ammonium ethylenediamine-tetraacetate | 55 g |
| Disodium ethylenediaminete-traacetate | 5 g |
| Water to make | 1,000 ml |
| pH (25° C.) | 6.70 |

The specimens were measured for density to determine the relative sensitivity of blue-sensitive layer, green-sensitive layer and red-sensitive layer.

Another batch of Specimens 201 and 202 which had not been exposed and processed were aged at a temperature of 30° C. and a relative humidity of 60% for 1 month, subjected to the above mentioned treatment and then measured for photographic properties and sensitivity.

The results are set forth in Table 7.

TABLE 7

| | Relative sensitivity (B) | | Relative sensitivity (G) | | Relative sensitivity (R) | |
|---|---|---|---|---|---|---|
| Specimen No. | Before ageing | After ageing | Before ageing | After ageing | Before ageing | After ageing |
| 201 | 100 | 81 | 100 | 86 | 100 | 80 |
| 202 | 100 | 89 | 99 | 91 | 97 | 90 |

Table 7 shows that the specimen of the present invention exhibits a small drop in the sensitivity even after untreated ageing.

In accordance with the present invention, the proliferation of fungi and bacteria in the photographic light-sensitive material can be inhibited effectively at a low cost with a small amount of the compound of the present invention. The use of the germicide and fungicide of the present invention provides an improvement in untreated ageing properties of the light-sensitive material and an effective inhibition of discoloration of color images formed by the processing of the light-sensitive material. The present invention also causes no deterioration in the conditions of the coating surface.

While the invention has been described in detail and with reference to specific embodiments thereof, it will be apparent to one skilled in the art that various changes and modifications can be made therein without departing from the spirit and scope thereof.

What is claimed is:

1. A silver halide photographic material, which comprises at least one aminoglycoside selected from the group consisting of gentamicins, amikacin, tobramycin, dibekacin, arbekacin, micronomicin, isepamicin, sisomicin, netilmicin, and astromicin, in a hydrophilic colloidal layer on a support.

2. The silver halide photographic material of claim 1, wherein the at least one aminoglycoside is present in an amount of about 0.01 to 20 mg/m$^2$.

3. A silver halide photographic material, which comprises at least one gentamicin in a hydrophilic colloidal layer on a support.

4. The silver halide photographic material of claim 3, wherein the at least one gentamicin comprises a mixture of gentamicin $C_1$, gentamicin $C_{1a}$ and gentamicin $C_2$.

5. The silver halide photographic material of claim 3, wherein the at least one gentamicin is present in an amount of about 0.01 to 20 mg/m$^2$.

* * * * *